US009537196B2

(12) United States Patent
Federmann et al.

(10) Patent No.: US 9,537,196 B2
(45) Date of Patent: Jan. 3, 2017

(54) HIGH POWER HIGH FREQUENCY LOADS FOR ENERGY RECOVERY

(75) Inventors: Silke Federmann, Gex (FR); Fritz Caspers, St. Genis Pouilly (FR); Michael Betz, Ferney-Voltaire (FR)

(73) Assignee: CERN—European Organization for Nuclear Research, Geneva (CH)

( * ) Notice: Subject to any disclaimer, the term of this patent is extended or adjusted under 35 U.S.C. 154(b) by 116 days.

(21) Appl. No.: 14/241,792

(22) PCT Filed: Aug. 28, 2012

(86) PCT No.: PCT/EP2012/003613
§ 371 (c)(1),
(2), (4) Date: Apr. 29, 2014

(87) PCT Pub. No.: WO2013/029781
PCT Pub. Date: Mar. 7, 2013

(65) Prior Publication Data

US 2014/0253263 A1 Sep. 11, 2014

(30) Foreign Application Priority Data

Sep. 2, 2011 (EP) ..... 11007148
Dec. 12, 2011 (EP) ..... 11193071

(51) Int. Cl.
*H01P 1/26* (2006.01)
*H01P 1/28* (2006.01)

(52) U.S. Cl.
CPC ..... *H01P 1/264* (2013.01); *H01P 1/262* (2013.01); *H01P 1/266* (2013.01); *H01P 1/28* (2013.01)

(58) Field of Classification Search
CPC ..... H01P 1/264
USPC ..... 333/22 R, 81 B, 248, 251
See application file for complete search history.

(56) References Cited

U.S. PATENT DOCUMENTS

| | | | | |
|---|---|---|---|---|
| 2,203,806 A | | 6/1940 | Wolf | |
| 2,594,037 A | * | 4/1952 | Landon | H01P 1/205 333/100 |
| 3,474,354 A | | 10/1969 | Simon | |
| 3,660,784 A | | 5/1972 | Scharfman | |
| 3,783,414 A | | 1/1974 | Klein et al. | |
| 5,268,546 A | | 12/1993 | Berg | |
| 5,910,710 A | * | 6/1999 | Simpson | H05B 41/24 315/236 |

FOREIGN PATENT DOCUMENTS

GB 1351720 A 5/1974

OTHER PUBLICATIONS

Matsumoto et al., High power evaluation of X-band power load, (CERN-ATS-2010-217) (Oct. 29, 2010).
International Search Report and Written Opinion, corresponding International Application No. PCT/EP2012/003613, mailed Dec. 4, 2012.

* cited by examiner

*Primary Examiner* — Dinh T Le
(74) *Attorney, Agent, or Firm* — Marshall, Gerstein & Borun LLP

(57) ABSTRACT

A radio frequency load for absorbing a radio frequency wave having a frequency in a predetermined frequency band and a wavelength comprises a waveguide with a portion having an opening for said radio frequency wave. In addition, the radio frequency load comprises at least one metal rod provided in said waveguide, said at least one metal rod having a length of one-half of said wavelength to damp said radio frequency wave.

38 Claims, 24 Drawing Sheets

Table 1:

| | diameter of rods [mm] | | | |
|---|---|---|---|---|
| $\mu$ | 15 | 20 | 30 | 35 |
| 1 | -11.7 | -14.2 | -12.9 | -5.8 |
| 5 | -19.2 | -14.7 | -5.2 | -2.5 |
| 10 | -12.2 | -10.1 | -3.8 | -1.9 |
| 25 | -7.6 | -6.4 | -2.6 | -1.3 |
| 50 | -5.6 | -4.8 | -1.9 | -1 |

Table 2: :

| | diameter of rods [mm] | | | |
|---|---|---|---|---|
| $\mu$ | 15 | 20 | 30 | 35 |
| 1 | -6.5 | -8.4 | -29 | -10.9 |
| 5 | -17.3 | -30.9 | -8.7 | -4.5 |
| 10 | -47.3 | -18.9 | -6.1 | -3.3 |
| 25 | -14.1 | -10.3 | -4 | -2.3 |
| 50 | -9.7 | -7.3 | -3 | -1.7 |

Fig. 9b

| 1 rod | | 3 rods | | 6 rods | |
|---|---|---|---|---|---|
| diameter of rods [mm] | dB | diameter of rods [mm] | dB | diameter of rods [mm] | dB |
| 10 | -3,51 | 10 | -6,74 | 10 | -12,98 |
| 15 | -2,55 | 15 | -11,1 | 15 | -7,93 |
| 20 | -2,14 | 20 | -21 | 20 | -24,92 |
| 30 | -1,55 | 30 | -26 | 30 | -26,18 |
| 35 | -1,54 | 35 | -22,3 | 35 | -21,62 |

Fig. 11a

| 1 rod | | 3 rods | | 6 rods | |
|---|---|---|---|---|---|
| diameter of rods [mm] | dB | diameter of rods [mm] | dB | diameter of rods [mm] | dB |
| 10 | -1,72 | 10 | -13,7 | 10 | -22,99 |
| 15 | -1,29 | 15 | -20,12 | 15 | -17,37 |
| 20 | -1,08 | 20 | -13,62 | 20 | -19,8 |
| 30 | -0,79 | 30 | NN | 30 | -12,5 |
| 35 | -0,78 | 35 | -13,75 | 35 | -11,97 |

Fig. 11b

| 1 rod | | 3 rods | | 6 rods | |
|---|---|---|---|---|---|
| diameter of rods [mm] | dB | diameter of rods [mm] | dB | diameter of rods [mm] | dB |
| 10 | -1,11 | 10 | -13,55 | 10 | -3,69 |
| 15 | -0,85 | 15 | -28,81 | 15 | -0,53 |
| 20 | -0,71 | 20 | -19,45 | 20 | -1,12 |
| 30 | -0,5 | 30 | -19,27 | 30 | -6,93 |
| 35 | -0,48 | 35 | -14,38 | 35 | -9,26 |

Fig. 11c

HIGH POWER HIGH FREQUENCY LOADS FOR ENERGY RECOVERY

FIELD OF THE INVENTION

The present invention relates to a radio frequency load (absorber) for absorbing a radio frequency (RF) wave and, in particular, to a high temperature high power band RF load without dielectric material but using a special geometry, ceramic foam or thin ferrite layers instead.

BACKGROUND AND RELEVANT STATE OF THE ART

High power radio frequency loads can be formed as waveguides or coaxial cables. Commonly used loads can be divided into two types: (i) loads that heat up water directly; and (ii) absorbing materials on water cooled metal surfaces. Both methods face different problems such as the necessity of using more or less fragile ceramic windows when heating water directly, or the application of ceramic layers onto cooled surfaces via soldering, brazing, press-fitting or gluing. The soldering or pressing process itself may be rather complex and critical, since the applied absorber materials are very small bits. In addition, the commonly used high power RF loads use dielectric and specific ferrite-type ceramic elements, which make them delicate in handling and manufacturing.

In addition, the absorbing materials have different coefficients of thermal expansion and face problems with inhomogeneous heat transformation caused by the different thermal expansion coefficients. In particular, interfaces between metals and ceramic materials lead to limitations of operative temperature.

In general, conventional RF high power loads are designated for an outlet water temperature of less than 80° C. and, in addition, for rather low pressure (e.g. <16 bar). The currently available dielectric free loads operating for frequencies of 7 GHz and above use a corrugated waveguide (e.g. with grooved surfaces) operating near the cut-off frequency and applying metallic loss mechanisms. An example of such a load is described in S. Matsumoto et. al. "High Power Evaluation of X-Band Power Load" (CERN-ATS-2010-217).

Further commonly used high power RF loads use relatively thick (e.g. more than 5 mm) dielectric or ferrite type ceramic elements, which are brazed to a metallic surface. Joining (brazing) ceramic type absorbing materials on water cooled surfaces is a critical and complex process. The different thermal expansion coefficients between the (thick) ceramic and metal renders such structures mechanically delicate in manufacturing and operating, usually limiting the maximal temperature and pressure rates to be below 80° C. Cooling water with those parameters has very limited economical value. Such ferrite layers are also disclosed in U.S. Pat. No. 5,268,546 for a microwave oven to provide a browning plate by a absorbing part of the microwave radiation.

Therefore, there is a need of providing reliable RF loads that are mechanically uncritical and usable at a high temperature (e.g. up to 200° C. or even more) and are able to sustain a high pressure (e.g. pressures of up to 100 bars). Reliable and robust RF power loads permitting high outlet temperature and high pressures of the cooling water are, in particular, interesting in the context of energy saving and recovery requirements. Conventional RF power loads containing dielectric and magnetic materials as well as sensitive ceramic windows usually do not permit going much higher than 80° C. It is an object of the present invention to overcome these limitations.

Overview of the Present Invention

The aforesaid problems are solved by a radio frequency load according to claim 1, 18, 23 or 29. Claims 2-17, 19-22, 24-28 and 30-36 provide advantageous realizations of the subject matters of the independent claims.

Accordingly, the present invention provides a radio frequency load for absorbing a radio frequency wave having a frequency in a predetermined frequency band and a wavelength λ. The radio frequency load comprises a means for guiding the radio frequency wave with a portion having an opening for the RF wave, and a means for absorbing of the radio frequency wave, wherein the means for absorbing comprises metal or ceramic foam and is arranged inside the waveguide. For example, the means for absorbing is formed as a metal structure, which is configured to damp the radio frequency wave either by absorbing at least partially the radio frequency wave or by defining a means for anti-reflection of the radio frequency wave that has entered the waveguide via the opening.

According to embodiments of the present invention alternative realizations are defined for the means of absorbing so that the present invention provides two solutions for the afore-mentioned problems. In the context of the present invention the absorption of, for example, an RF wave does not need to complete (i.e. 100% absorption). Embodiments relate also to partial absorption of a wave (i.e. provide only a damping).

A first solution relates to a radio frequency load for absorbing a radio frequency wave having a frequency in a pre-determined frequency band and a wavelength λ, wherein the radio frequency load comprises: a waveguide portion having an opening allowing the radio frequency wave to enter the waveguide portion. The radio frequency load comprises moreover at least one metal rod provided in the waveguide, wherein the at least one metal rod having a length of one half or an integer multiple of the wavelength λ and, optionally, comprises a means for cooling any of these metal rod. This solution relies on the effect that the RF wave induces a current in the metal rod(s) and the current in turn heats the metal rods, thereby absorbing the energy of the RF wave. Therefore, in this solution the metal rods act as couple resonators, which absorb the RF waves. Accordingly, in further embodiments a plurality of metal rods can be provided, which have either the same length, but are arranged at different angles to each other or comprise different lengths so that a whole frequency band (e.g. the pre-determined frequency band) can be absorbed by one RF load.

A second solution relates to a radio frequency load for absorbing a radio frequency wave having a frequency in a predetermined frequency band and a wavelength λ, wherein the RF load now comprises: a coaxial TEM (TEM= transverse electric and magnetic) transmission line with a portion having an opening for the radio frequency wave, wherein the coaxial TEM transmission line comprises an inner conductor, an outer conductor, and a conductive plate arranged on an opposite side to the opening to provide a short circuit between the inner and outer conductor. The RF load comprises furthermore one or more metal structures being arranged between the inner conductor and the outer conductor. The one or more metal structures are arranged in a predetermined distance from the conductive plate to absorb the radio frequency wave. This solution relies on the effect that the space between the metal structure and the conductive plate defines a resonating region (resonator). This resonator is the actual absorbing element. The absorption heats up the metal structure itself, but also the region between the metal structure and the conductive plate i.e. the complete volume of the resonator.

In further embodiments of the second solution the one or more metal structures may, for example, connect the inner and outer conductor and may be configured to be transmissive for a part of the radio frequency wave and reflective for a remaining part of the radio frequency wave (e.g. if the RF wave consist of the part and the remaining part). The one or more metal structures may comprise a metal disc with holes arranged along a circumferential direction of the metal disc. As further possibility the one or more metal structures may comprise one or more of radial metal rods extending along a radial direction of the coaxial transmission line to connect the inner conductor with the outer conductor. Both possible configurations can also be combined, for example, in that multiple metal structures are arranged at different positions along the axial direction. By such a configuration the RF load becomes sensible for multiple frequencies of the frequency band. In further embodiments the radial metal rods can be provided with a passage for a cooling medium from the outer conductor to the inner conductor to cool the at least one radial metal rod together with the inner conductor with the cooling medium.

In further embodiments also the at least one metal rod of the first solution is hollow such as to define tubes for carrying a cooling medium allowing a temperature of more than 100° C. and a pressure of more than 20 bar. This effect can be achieved, e.g., by the concrete dimension of the tubes (e.g. the internal diameter of the tubes) and the thickness of the tube side wall, which has to be provided such that a pressure of more than 20 bars can be sustained. Also the material of the metal rods has to be chosen appropriately (e.g. stainless steel) to withstand these conditions. To provide reliability even at temperatures of more than 150° C. and pressures of up to 100 bar, the at least one metal rod in the RF load may be ceramic-free and/or dielectric-free.

The high operation temperature and high pressure provide the advantage that water can efficiently be used for energy recovery. Thus, the RF load comprises, optionally, a means for cooling which provides the cooling medium to the tubes, and the means for cooling may, for example, comprise a Stirling motor or any other energy recovery device to transform, for example, hot steam in energy.

In order to improve the conversion of the radio frequency wave into heat in the metal rods, the surface of the metal rods can be threaded or can comprise any other rough surface structure which increases the resistivity of the surface.

In further embodiments the RF load comprises a terminating surface opposite to the opening, which is provided with an electric conductive plate as e.g. made of copper or any other conductive material.

In further embodiments, the different physical parameters can be chosen as follows. The frequency of the RF wave may be for coaxial configurations between 10-3000 MHz, in particular between 100-500 MHz, or more particularly between 200-400 MHz and for waveguide configurations between 300 MHz-3 GHz. These frequency bands have the effect that the RF waves are transformed effectively into heat by inducing electric currents in the metal rods. The at least one metal rod may, for example, comprise a diameter within a range of 5-50 mm, preferably between 10-35 mm, and comprise a material with a magnetic permeability of less than 5, and, in particular, of less than 2 (as e.g. steel or stainless steel). These parameters provide an improved absorption of the RF waves of the mentioned frequencies. In addition, the at least one metal rod may comprise a material with a coefficient of (linear) thermal expansion of less than $10^{-5}$ $K^{-1}$, and in particular of $<10^{-6}$ $K^{-1}$ as e.g. Invar. Since the operating temperature may be well above 100° C. (e.g. more than 150° C.) this property provides the advantage that the thermal expansion is rather low, thereby providing an improved frequency stability of this resonating RF load.

In further embodiments the at least one metal rod may comprise a plurality of metal rods that can be arranged in a particular pattern. For example, a first group of metal rods may be arranged in parallel within a first common plane, and a second group of metal rods may be arranged in parallel within a second common plane.

In further embodiments the waveguide comprises a rectangular cross section perpendicular to a propagation direction of the radio frequency wave such that the rectangular cross section comprise a long side and a short side, and wherein the first common plane and the second common plane are inclined with respect to the long side and with respect to the short side. Examples for the dimensions of a waveguide type 350 MHz load are: the long side may be in a range of 300-700 mm and the short side may be in a range of 150-400 mm, and the waveguide may comprise a length in the propagation direction between 1000 and 2000 mm, and in particular between 1200 and 1700 mm. These geometric dimensions of the RF load are adapted to the above mentioned frequency bands such that an effective absorption become possible.

In further embodiments each metal rod in the first group and each metal rod in the second group are arranged closer to the conductive plate (at the terminating surface) than to the opening of the waveguide.

In further embodiments the transmission line comprises a coaxial shape with an inner conductor and an outer conductor and wherein the at least one metal rod is arranged along the axial direction of the coaxial transmission line. For example, the at least one metal rod may be arranged in parallel to the outer conductor.

In further embodiments the at least one metal rod includes a plurality of metal rods being mounted equidistantly in angular direction of the coaxial transmission line on the outer conductor (or/and on the inner conductor). In addition, the electric conductive plate shall connect the outer conductor with the inner conductor such as to provide a short between the outer and inner conductor.

The dimensions of coaxial transmission line configuration may be chosen as follows. The inner conductor may comprise an inner diameter between 100-200 mm, the outer conductor may comprise an outer diameter between 250-500 mm, and the length of the coaxial transmission line may be between 170 cm to 300 cm (in particular about 200 cm). The at least one metal rod may be separated from the conductive plate by at least 40 mm (or between 20 and 70 mm). The distance of the metal rods from the metal plate can be adjusted to augment the coupling and consequently the absorption effect.

The present invention provides the following advantages. At first, the RF load provide reliability and radiation hardness and, in addition, is more robust in handling and easier to manufacture (e.g. by using metal or steel as material). In addition, embodiments withstand high temperature, fairly high pressures and can be operated to some extend in vacuum. They allow operation at lower frequencies than the conventional dielectric free loads (waveguide operating near the cut-off). Resonant structures (typically lambda over 2 resonators) made of steel can be installed in large waveguides for frequencies from 300 MHz onward. For coaxial line geometry with large dimensions resonant structures going as low as 100 MHz may take advantage of the rather high current losses of normal steel. The coaxial structure is reliable and robust even against thermo-acoustic shock waves caused by pulsed RF signals.

The maximum achievable coupling to the resonating structure is limited by mechanical constraints, which in turn dictates the Q value of the resonant circuit. To achieve a high Q value, materials with low surface impedance can be used, like good conductor materials such as cooper.

In addition, the provided loads are rather inexpensive and show good mechanical robustness. They are not critical in handling (no delicate pieces) and ionizing radiation hard. The metal tubes used can be water or oil cooled so that an efficient energy recovery is possible (following the principle of pressurized water heat exchanger).

Moreover, the loads according to embodiments can be connected to ultra high vacuum (UHV) via standard vacuum seals. The transition section between the UHV and the high power load can be done via copper plated bellow (e.g. with a copper coating thickness of 10 μm) or coaxial line with very thin walls (stainless steel for poor heat conduction less than 1 mm wall thickness and few μm copper coating inside). Such a bellow ensures good RF properties. It is furthermore capable of bridging the temperature differences from the hot high power load at, for example, more than 200° C. to the RF feeder line at ambient temperature.

Further solutions of the above mentioned problem relate also to resonant structures which by their geometry have a low Q (which may be as low as possible), but which can further be reduced by an optional coating of the inner surface or parts thereof with a ferromagnetic or ferrite layer. The quality factor Q of a resonant circuit is defined as the ratio of stored energy W over the energy dissipation P in one cycle ($Q=\omega_{res}$ W/P).

One of these embodiments relate to a radio frequency load comprising an absorption portion having an opening for said radio frequency wave, an inlet structure and a terminating surface to provide a resonator for said radio frequency wave, and a plurality of absorber elements arranged between said inlet structure and said terminating surface and which are configured to damp said radio frequency wave.

The inlet structure and the terminating surface may optionally be spaced from each other such that an incoming radio frequency wave forms a standing wave. Alternatively, the spacing is such that a λ/4-absorber is formed (i.e. the distance is about one quarter of the wavelength inside the waveguide). In addition, the absorption portion may comprise a larger extension than the opening measured perpendicular to a propagating radio wave and the radio frequency load may further comprise a tapered portion connecting the opening with the enlarged absorption portion.

In addition, the plurality of absorber elements may be formed as a stack of metal plates comprising tubes providing a flow path for a cooling liquid and which are separated from each other. Moreover, at least one of the plurality of absorber elements and/or the inlet structure may comprise a ferrite coating. The optional ferrite may be deposited by plasma spraying, thereby avoiding thermal stresses and forming a thin layer (e.g. of less than 1 mm in particular less than 500 μm).

In further embodiments the plurality of absorber elements extend from the terminating surface to the inlet structure and each of the plurality of absorber elements comprises an optional cavity. The inlet structure may optionally be formed as a plurality of openings for providing a propagation path of an incoming RF wave into the cavity of each the plurality of absorber elements. These cavities may also optionally be coated by a thin ferrite layer to improve the absorption of the RF wave.

Yet another embodiment relate to a radio frequency load comprising an enclosure (e.g. a metal housing) with an opening for the radio frequency wave, ceramic foam may be arranged inside the enclosure such that the radio frequency wave along its propagation passes at least partly the ceramic foam. In addition, a cooling gas inlet is configured to provide the cooling gas as cooling medium to the ceramic foam, wherein the ceramic foam is configured to absorb the radio frequency wave, thereby heating the ceramic foam and, because the ceramic foam is also configured to be permeable for the cooling gas, the heated ceramic foam is cooled by the cooling gas passing the ceramic foam.

Optionally, the cooling gas inlet structure may be formed as a perforated waveguide portion (e.g. along a side wall of the wave guide). The enclosure may, for example, comprise metal and an optional thermal insulation with an optional additional cooling. The additional cooling may be coupled to the cooling gas circulation or may be cooled by cooling water flowing through separate tubes provided in the thermal insulation. This combination of thermal insulation and additional cooling may cool the outside surface of the enclosure down to ambient temperature or slightly above (e.g. at most double of the ambient temperature).

In further embodiments the RF load comprises an inlet structure and a perforated shield providing a terminating surface for preventing the radio frequency wave from leaving the enclosure. The inlet structure and the perforated shield are configured to provide a resonator for the radio frequency wave by forming a standing wave from an incoming radio frequency wave. The perforated shield may further be configured to provide an outlet for the cooling gas (e.g. by perforations) after the cooling gas has passed at least part of the ceramic foam.

Finally, in further embodiments the ceramic foam comprises one or more air passage ways providing a flow path for the cooling gas, wherein the air passage ways are free of ceramic foam to alleviate a flow of the cooling gas through the ceramic foam.

Further embodiments may comprise a radio frequency wave window provided at said opening, wherein said radio frequency wave window is configured to be permeable for said radio frequency wave and is configured to block gas.

The aforementioned embodiments or different aspects of the aforementioned embodiments may also be combined to defined further advantageous realizations of the claimed subject matter.

Advantages of the further embodiments are related to the fact that these high power loads are mechanically robust and provide either a cooling liquid with high pressure and temperature (e.g. ≤100 bar, ≥150° C.) at the outlet or very hot air (up to 800° C.). The cooling liquid (typically water) as well as the hot air could then be used for energy recovery as, for example, by using a Stirling motor or domestic heating distribution system. The RF load can be designed in a frequency range between 200-7000 MHz operating in a narrow band within this same range. The absorbing elements constitute a flat resonator and allow cooling with highly pressurized, very hot water/liquid.

DETAILED DESCRIPTION OF PREFERRED EMBODIMENTS

The features and numerous advantages of a load according to the present invention will be best appreciated from a detailed description of the accompanying drawings, in which:

FIG. 1*a* is a cross-sectional view of the a RF load according to a first embodiment;

FIG. 1*b* shows a further cross-sectional view of the RF load according to the first embodiment;

FIG. 2*a* is a cross-sectional view of a RF load according to a second embodiment;

FIG. 2*b* is a cross-sectional view of a RF load according to a third embodiment;

FIG. 2*c, d* are further cross-sectional views showing embodiments for the metal structure of the RF load of FIG. 2*b;*

FIG. 2*e-j* are perspective views of RF loads of FIG. 2*b;*

FIG. 3 depicts more details of the metal rods used in the first embodiments;

FIG. 4*a, b* depict embodiments for a means for cooling of the RF load;

Figure 7:
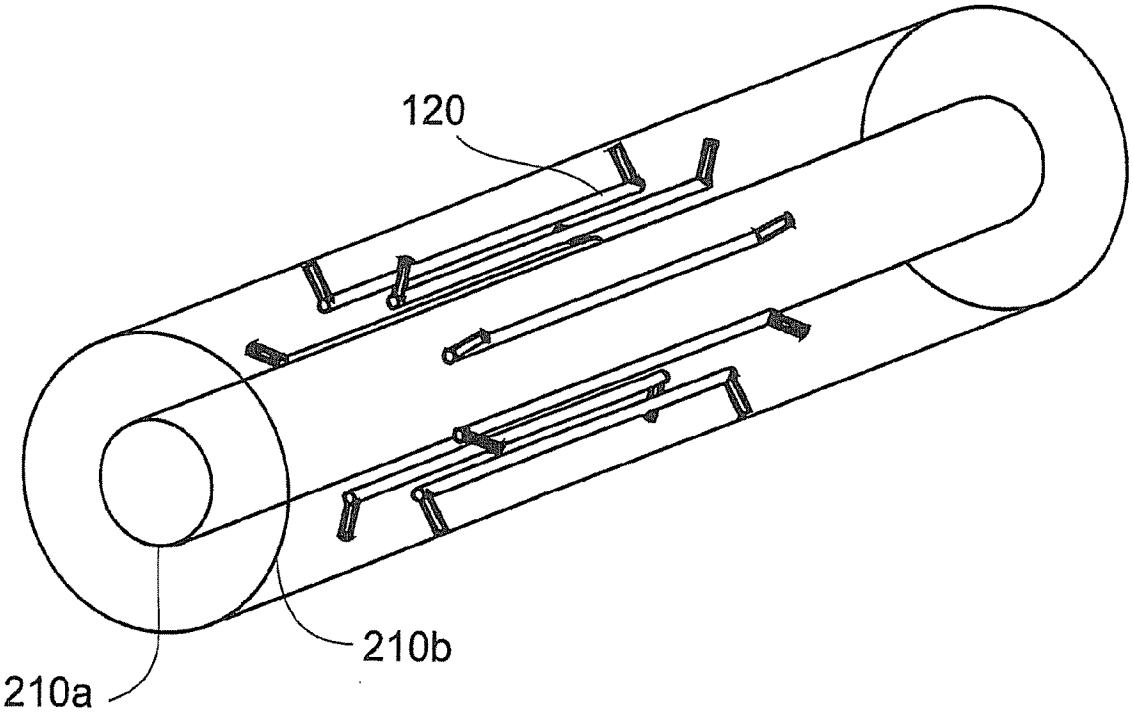
FIG. 7 is a perspective view of an RF load with a coaxial transmission line.
Figure 9A:
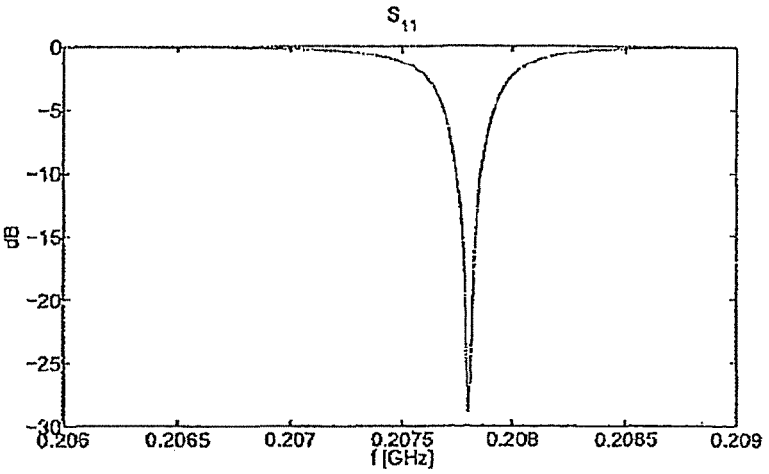
Figure 10:
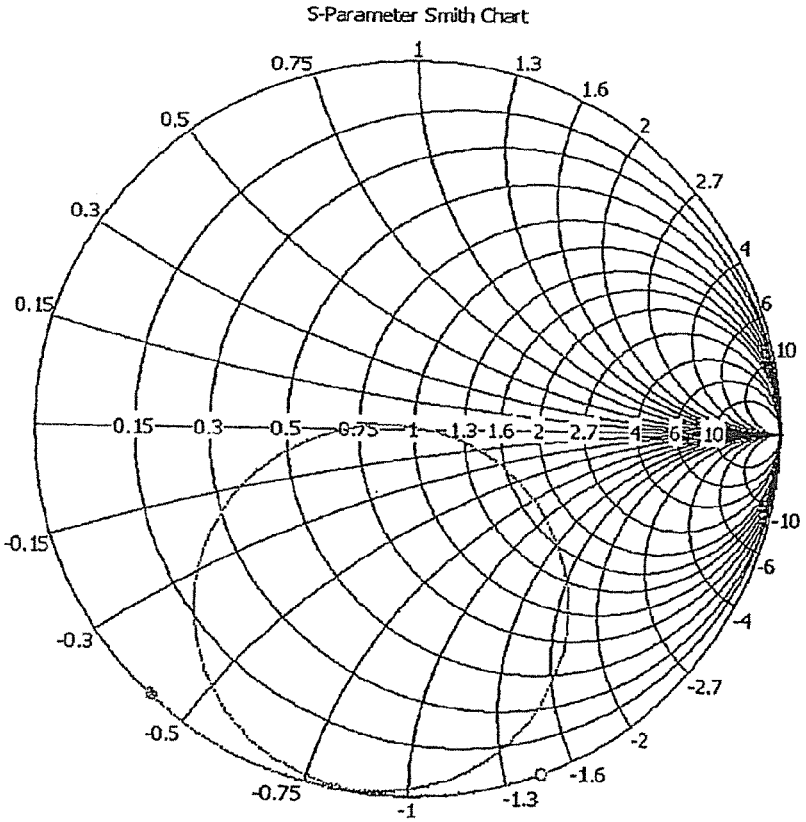
Figure 12:
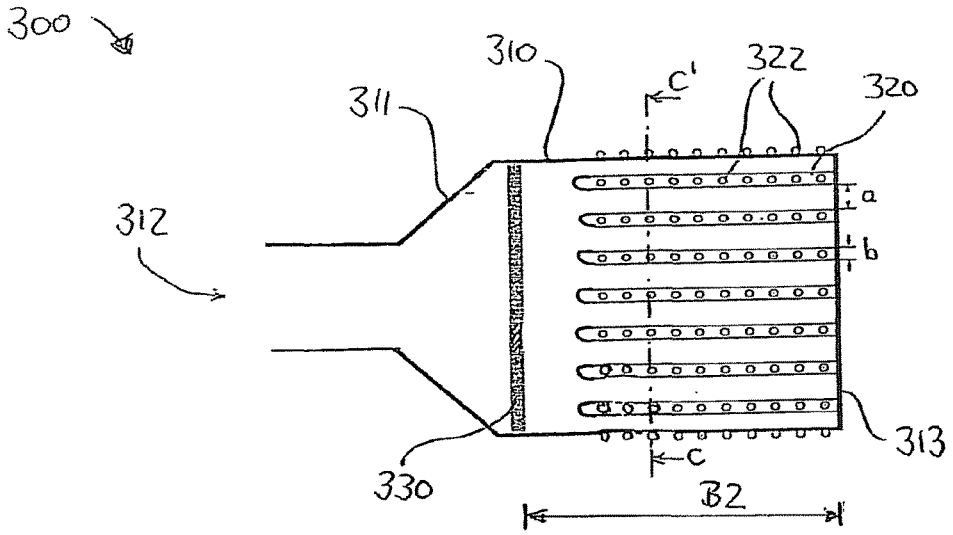
Figure 13:
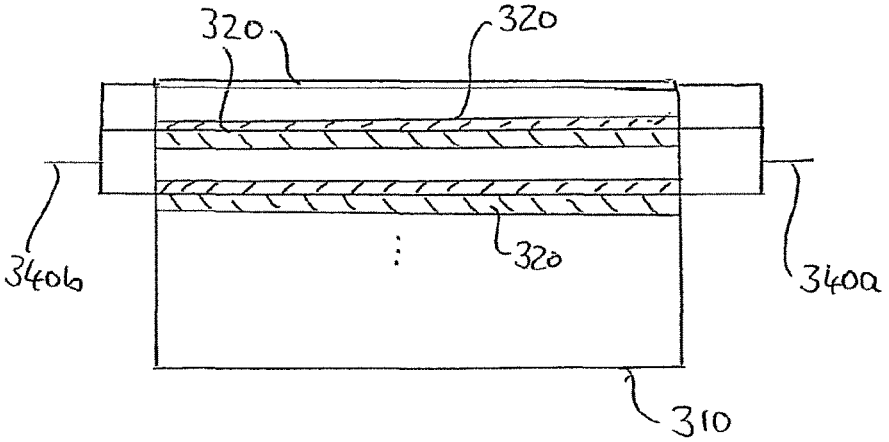

FIG. 9*a, b* show a diagram and tables with simulation results for the absorption of the radio frequency wave by using the coaxial RF load of FIG. 7;

FIG. 10 is a Smith Chart for the S-parameter of the RF load of FIG. 7;

FIG. 11*a, b, c* are tables showing absorption results;

FIG. 12 depicts a cross-sectional view of a resonant RF load according to a further embodiment;

FIG. 13 is a cross-sectional view of an RF load in a plane perpendicular to a propagating RF wave; and FIG. 14*a-d* are cross-sectional views of RF loads using ceramic foam according to further embodiments.

Figure 1A:
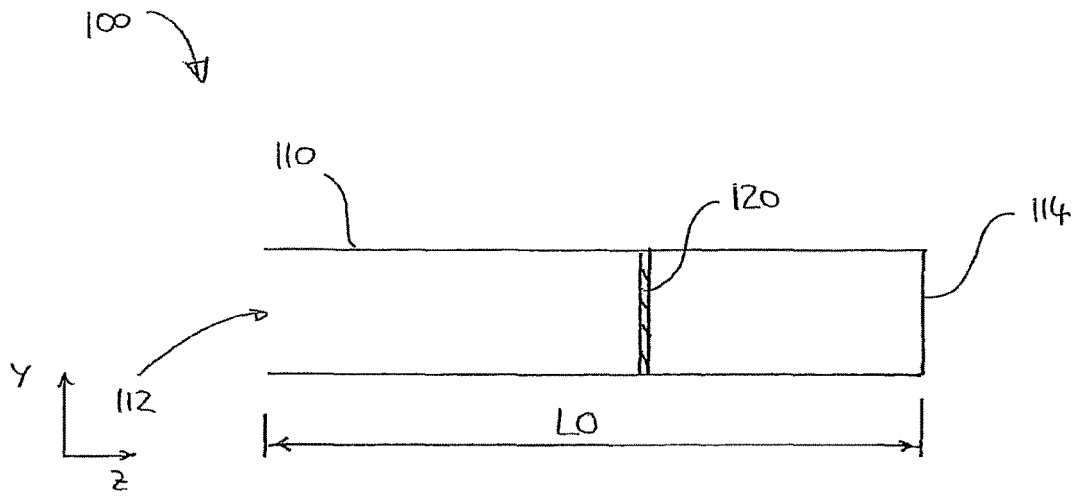

FIG. 1*a* shows a radio frequency load 100 for absorbing a radio frequency wave having a frequency in a pre-determined frequency band. The RF load 100 comprises a waveguide 110 with an opening 112 and at least one metal rod 120. The waveguide 110 is shown in propagation direction of the RF wave and comprises a length L0 as measured between the opening 112 to a terminating surface (back surface) at the opposite end. Optionally, the RF waveguide 110 is terminated by a metal plate 114 arranged at the surface opposite to the opening 112 of the waveguide 110.

Figure 1B:
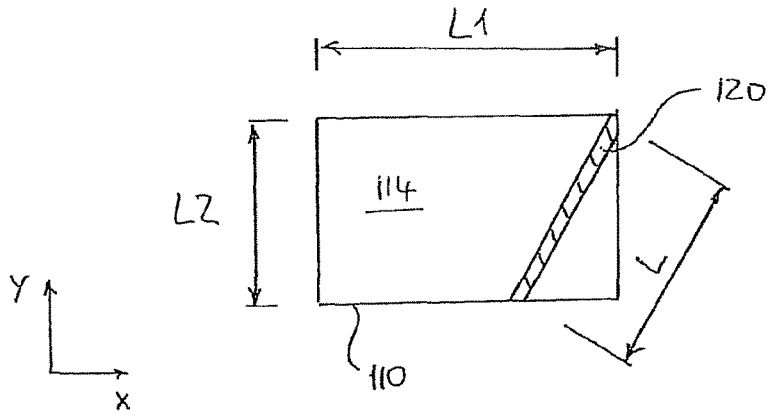

FIG. 1*b* shows a further cross-section of the waveguide 110, wherein the cross-section is now taken perpendicular to the propagation direction of the radio frequency wave. The metal rod 120 comprises a length L, which is equal or approximately equal to one half of the wavelength of the radio frequency wave. The length L can e.g. be arranged such that the mid-frequency $\lambda_0$ of a frequency band is used for defining the wavelength $\lambda_0$ for which the relation $L=\lambda_0/2$ holds. In further embodiments the highest or lowest frequency in the band is used for defining the length. The metal rod 120 is provided inside the waveguide 110 and may be separated from side walls of the waveguide 110 (see FIG. 1*b*) such that all sides are exposed to the RF wave.

The radio frequency wave enters the waveguide 110 through the opening 112 and is at least partly absorbed by the metal rod 120 by inducing an electric current in the metal rod 120 that fluctuates with the frequency of the radio frequency wave. Because the length L of the metal rod 120 is one half of the wavelength λ of the radio frequency wave, a resonance is generated in the metal rod 120. Due to the electric resistance, the electrons will dissipate the energy into heat, thereby heating the metal rods 120 so that finally the energy of the radio frequency wave is converted into heat of the metal rods 120 thus absorbing of the radio frequency wave. Because of the resonance the induced electric current is very intense (with a high current density) and fluctuates strongly, thus providing an effective absorption.

As shown in FIG. 1*b* the cross-section of the waveguide 110 may have a rectangular shape with one long side having a length L1 along the x-direction and one short side having a length L2 along the y-direction as defined in FIG. 1*b*. In other embodiments the long direction can also be in the y-direction whereas the short direction is in the x-direction. Possible ranges are: L1 between 200 mm and 350 mm (e.g. L1=290 mm) and L2 between 450 mm and 700 mm (e.g. L2=583 mm). The length of the RF load L0 is, e.g., between 900 mm and 1700 mm (e.g. L0=1350 mm). The diameter of the metal rod is e.g. between 5 mm and 35 mm (e.g. 10 mm) and, in addition, the metal rod 120 is, for example, arranged in the back half of the waveguide 110 so that the distance from the metal rod 120 to the back surface 114 is shorter than the distance from the metal rod 120 to the opening 112.

Figure 2A:
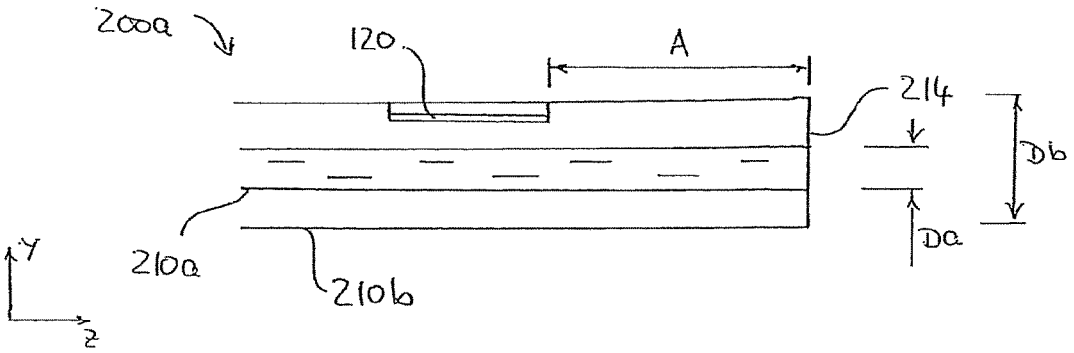

FIG. 2*a* shows an RF load 200*a* with a coaxial transmission line 210 comprising an inner conductor 210*a* and an outer conductor 210*b*. In addition, in this embodiment the metal rod 120 is arranged along a propagation direction of the RF wave and is spaced from the back surface by a distance A. This distance A can, for example, be optimized such that reflected waves from the terminating surface 214 increases the field strength in the resonator and does leading to an increase of the absorption in metal rod (e.g. A=λ/2, i.e. also one half of the wave length of the RF wave).

Figure 2B:
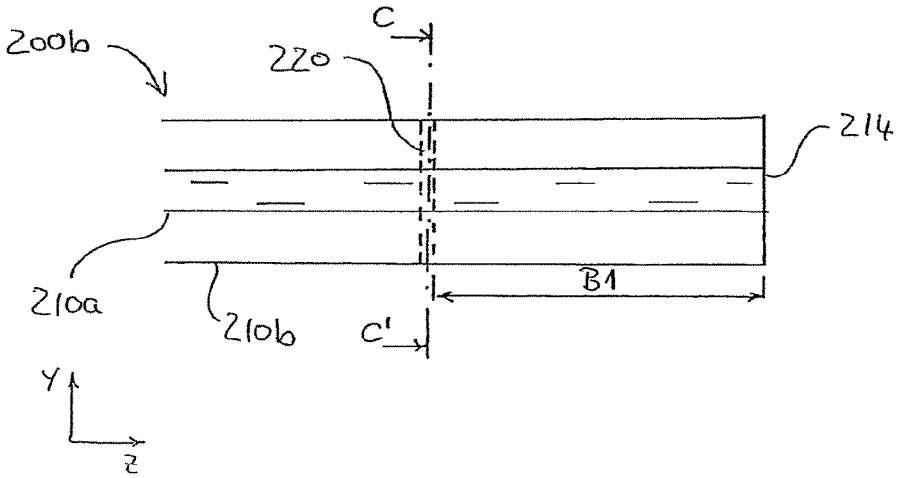

FIG. 2*b* shows a further RF load 200*b* with a coaxial transmission line 210 comprising an inner conductor 210*a* and an outer conductor 210*b*, but with a metal structure 220 arranged in a distance B1 from the terminating surface 214. The metal structure 220 is configured to obtain a resonator which is the absorber element 320. The distance B1 is arranged such that a maximum absorption is reached. The distance B1 can, for example, be arranged to be about one half of the wavelength of the RF wave (i.e. $B1=\lambda_0/2$) or 5% more or less of these values.

Possible dimensions of this coaxial waveguide (210*a*, 210*b*) are as follows. The outer conductor 210*b* may have a diameter Db=345 mm and the inner conductor 210*a* may comprise a diameter Da=150 mm, the distance B1 may be in the range of 40 to 60 mm, or equal to the length of the metal rods of the first embodiment (λ/2 because of the phase shift at the conductive plate 214).

Optionally, the inner conductor 210*a* is provided with a cooling tube, which can e.g. be combined with a hollow metal rod 120 to be cooled together.

Figure 2C:
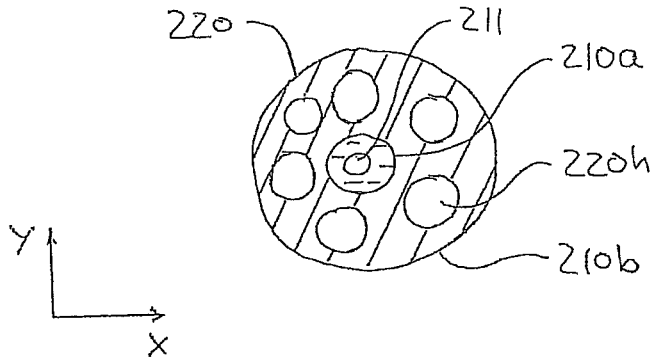

FIG. 2*c* is a cross-sectional view along the line C-C' of FIG. 2*b* and shows one embodiment for the metal structure 220 given by a metal disc with holes 220*h* surrounding the inner conductor 210*a*. For example, six or eight holes 220*h* can be arranged around the inner conductor 210*a* in an equidistant way and comprise a diameter Dc=86 mm. The width of the disc can be in a preferential configuration between 3 to 50 mm (e.g. 10 mm).

In further embodiments the holes 220*h* are replaced by other structures and also the area of the holes 220*h* can be modified in order to optimize the transmissive/reflective part of the incoming radio frequency wave.

Figure 2D:
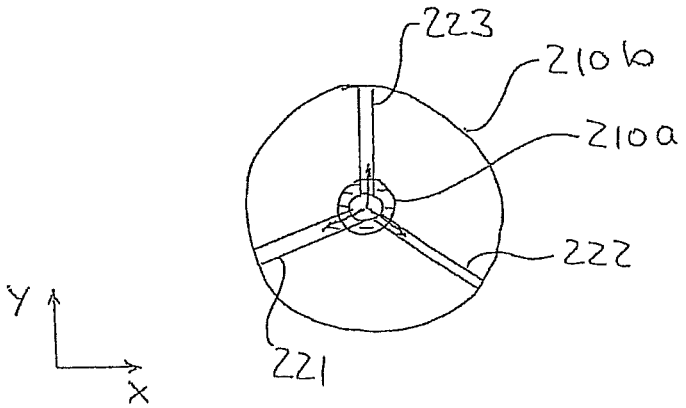

FIG. 2*d* shows again a cross-sectional view along the line C-C', but now for another embodiment of the metal structure 220, where the metal structure 220 is given by a plurality of radial metal rods. In detail, in this example three radial metal rods 221, 222, 223 are arranged equidistantly along the radial direction starting from the inner conductor 210*a* and connecting the inner conductor 210*a* with the outer conductor 210*b*.

Optionally, the inner conductor 210*a* can comprise a tube 211 for a cooling liquid. The tube 211 can optionally be connected with tubes of the radial metal rods 221, 222 and 223 to provide a flow for the cooling medium passing through the inner conductor 210*a* and the radial metal rods 221, 222, 223. Thus, a combined cooling for the inner conductor 210*a* together with a cooling of the radial metal rods 221, 222, 223 is achieved. In addition, also the conductive plate 214 and/or the region between the conductive plate 214 and the metal structure 220 are cooled by using the cooling medium.

Figure 2E:
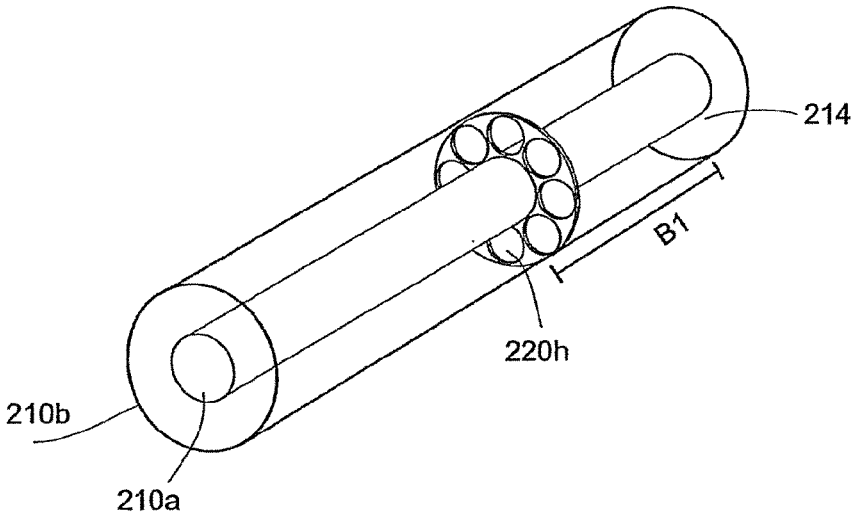
Figure 2F:
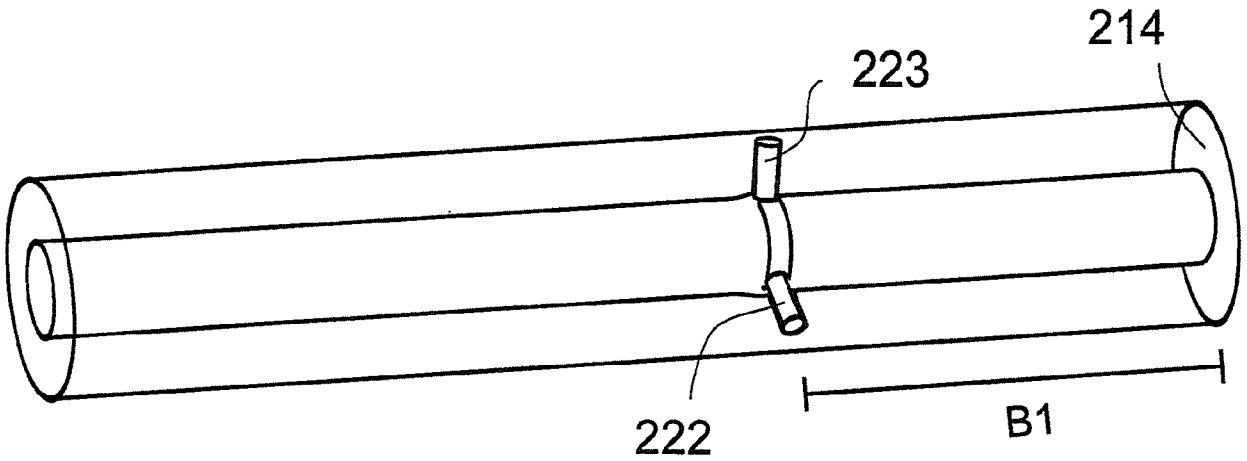
Figure 2G:
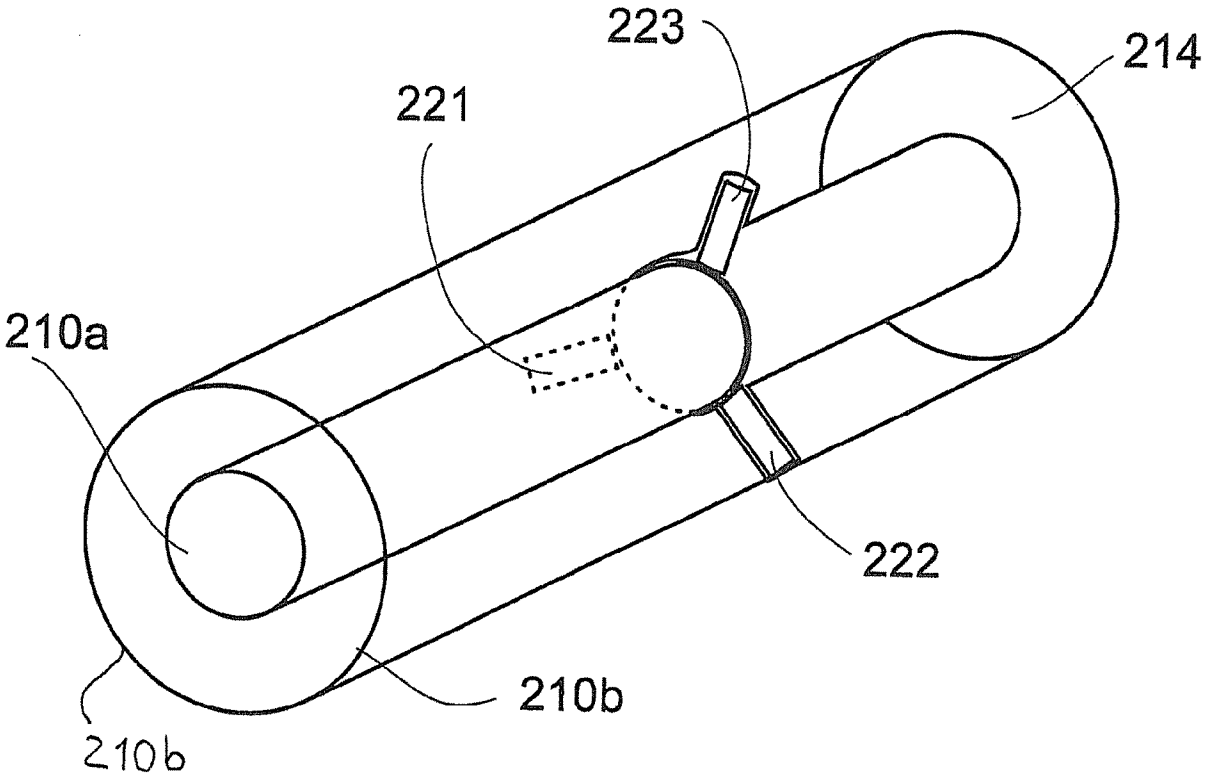
Figure 2H:
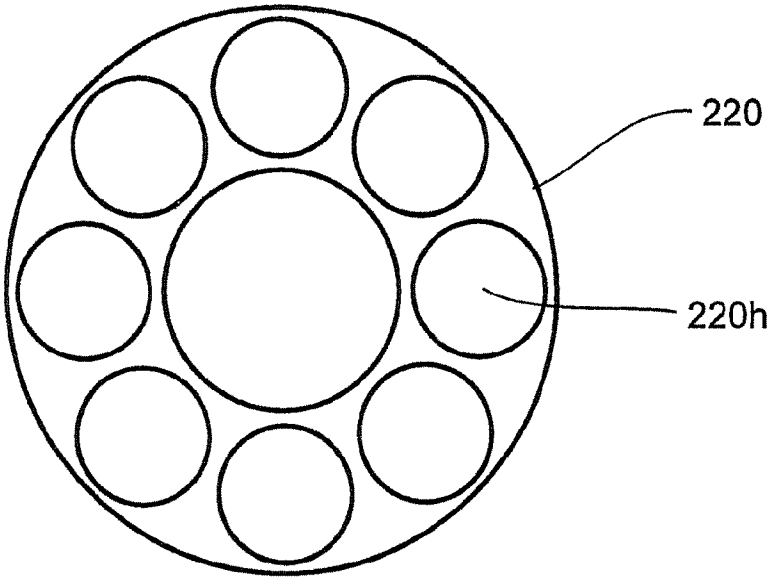
Figure 2I:
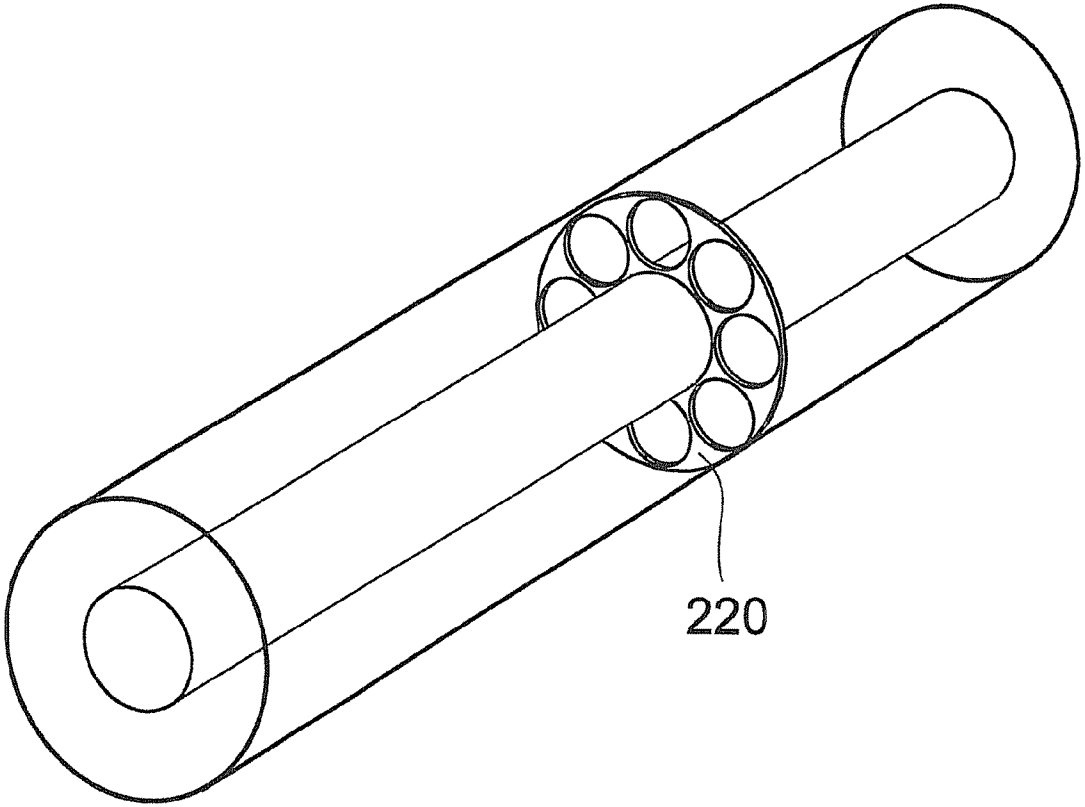
Figure 2J:
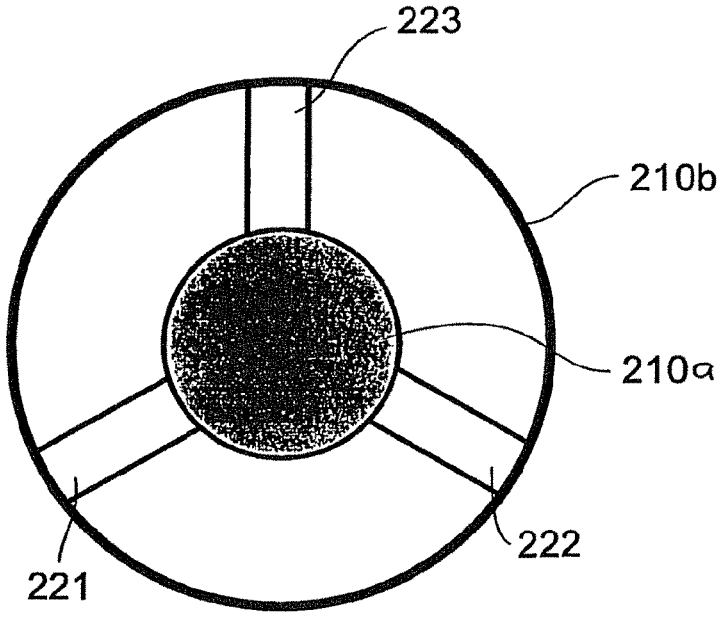

FIGS. 2*e*-2*g* depict perspective views of the RF load as shown in FIG. 2*b*-2*d*. In detail, FIG. 2*e* depicts an embodiment for the load of FIG. 2*c*, wherein the number of holes 220*h* is now eight and the distance B1 is adjusted in accordance to the RF wave to be absorbed. FIGS. 2*f* and 2*g* depict the RF load of FIG. 2*d*, wherein again three radial rods 221, 222, 223 are shown, which are also spaced from the conductive plate 214 (e.g. made of copper) by the same distance B. FIG. 2*h*-2*j* depict further views of the RF load of FIG. 2*b*, wherein metal disc 210 comprises 8 holes 220*h* (FIGS. 2*h* and 2*i*). FIG. 2*j* shows a further embodiment with the radial rods shown from the opening 112.

Figure 3:
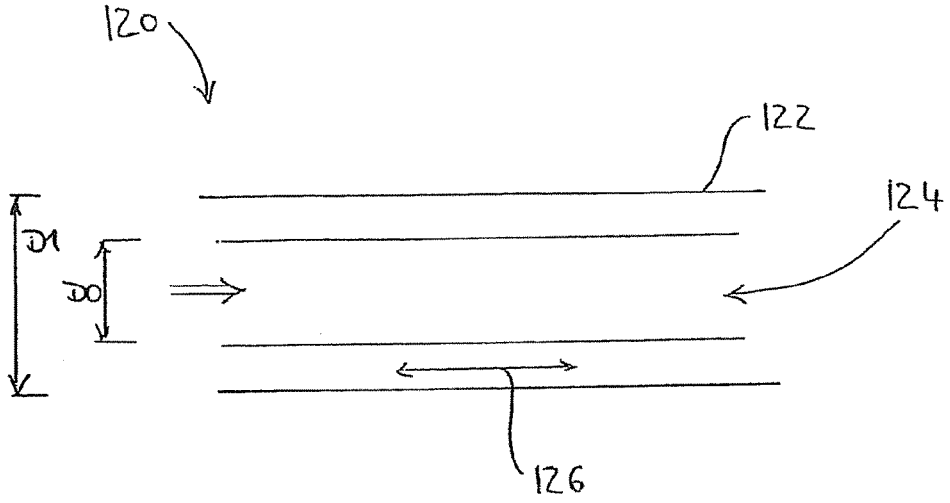

FIG. 3 shows in more detail a metal rod 120 in a cross-sectional view along the length direction of the metal rod 120 with a diameter of D1. The metal rod 220 comprises a surface 122 in order to increase the resistance for the oscillating current 126 as generated by the absorption of the radio frequency wave when passing through the waveguide 110. Optionally, the metal rod 120 comprises a tube 124 to provide a passage way for the medium for cooling the metal rods 120 as indicated by the arrow. The cooling medium may be a liquid, which can evaporate due to the heat generated by the absorbed RF wave. The diameter D0 of the tube 124 and the pressure of the cooling liquid can be adjusted accordingly. The internal diameter D0 of the tubes and the thickness of the tube side wall (D1–D0) can be adjusted to achieve a desired temperature (e.g. of more than 150° C.) and allow a pressure of more than 20 bars inside the tubes. In addition, also the material of the metal rods 120 has to be chosen appropriately (e.g. stainless steel) to withstand these conditions.

Figure 4A:
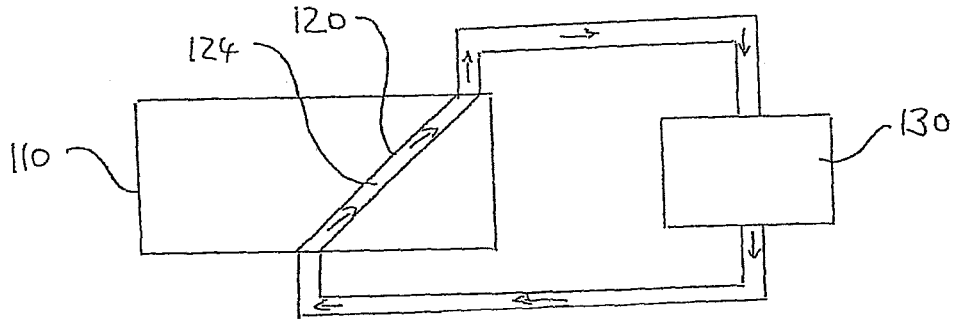

FIG. 4*a* shows a further embodiment comprising a means for cooling 130 connected to the metal rods 120, which comprise the tube 124 for the cooling medium such that a flow for the cooling medium is provided from the means for cooling 130 passing through the metal rods 120 and returning back to the means for cooling 130. The means for cooling 130 is, e.g., a heat exchanger or a Stirling engine or any other engine to be used for energy recovery. For example, the means for cooling may be configured to use pressurized water to generate energy from the heated water. Therefore, it is of advantage that embodiments of the present invention are configured to operate with high temperatures (i.e. above 150° C.) and with high pressures (more than 20 bar and up to 100 bar), because these conditions allow an efficient energy recovery.

Figure 4B:
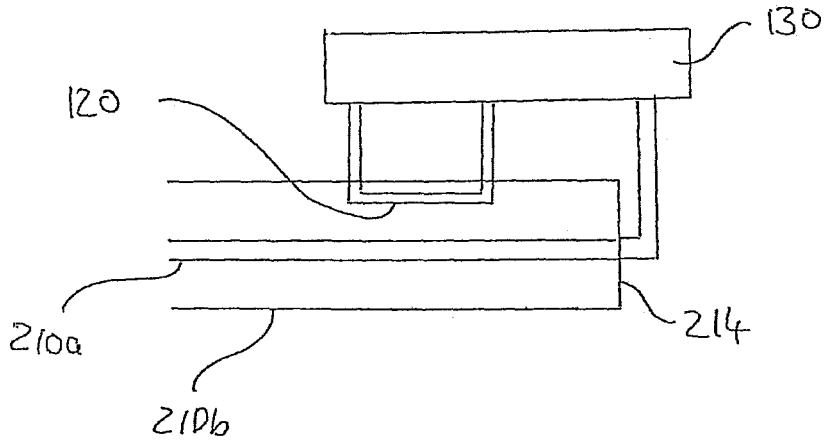

FIG. 4*b* shows a further embodiment, where the means for cooling is also provided for the coaxial transmission line such that the inner conductor 210*a* is cooled together with the metal rods 120 (e.g. by a single cooling circuit). A combined inlet/outlet for the cooling medium can be provided through the conductive plate 214 such that the cooling medium flows back inside the inner conductor 210*a*. Alternatively, an outlet may be provided at the opposite side of the metal plate 214. Optionally, the metal rod 120 can be mounted on the inner conductor 210*a*, thereby providing a single cooling circuit by directly connecting the tubes of metal rods 120 with a tube 211 of the inner conductor 210*a*.

Figure 5:
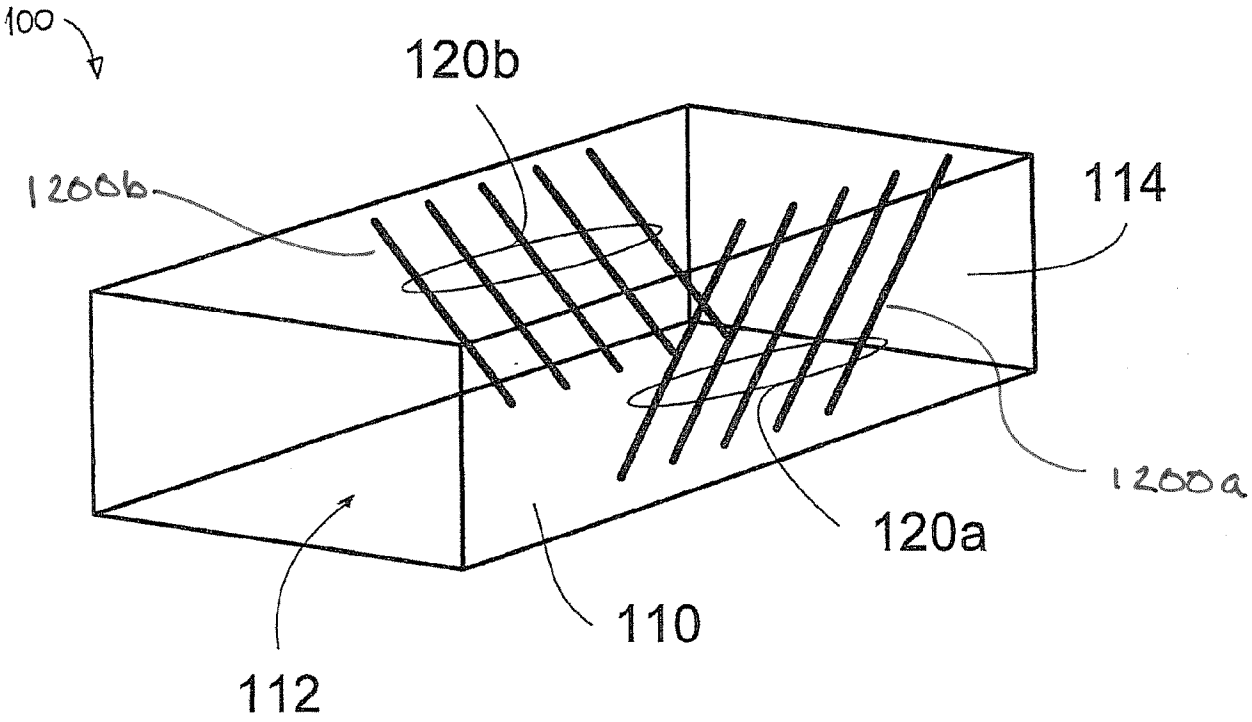
FIG. 5 is a perspective view of the RF load according to an embodiment.

FIG. 5 shows a perspective view of the embodiment as shown in FIGS. 1*a, b*. The RF load 100 comprises a rectangular cross-section, wherein a fist group of metal rods 120*a* is arranged in parallel within a first common plane 1200*a*, and a second group of metal rods 120*b* is arranged in parallel with a second common plane 1200*b*, wherein the first and second plane can have any angle between. The number of metal rods can, e.g., be six in each of the groups but can be different in other embodiments. The first group and the second group of metal rods 120*a, b* are provided in the back part of the RF load 100 such that all metal rods are closer to the back surface 114 than to the opening 112 (this relation holds either for any point of the metal rods or for the center of mass). IN addition, the metal rods 120 in the first and second group are all in a transversal direction of the propagating RF wave (i.e., they are arranged in parallel to the back surface 114, which may again be formed by a conductive plate).

As for the dimensions the following values define one possible configuration (the invention is not limited to these values). The waveguide for a frequency of 350 MHz (with a free space wave length $\lambda_0$) may have a cross-section of 583×290 mm and a length of 1350 mm. The total number of metal rods may be 12, which are tilted, have a length L of half of a free space wavelength ($L=\lambda_0/2$) and a diameter of 10 mm, and are inserted in the back half of the waveguide. Six rods are placed on one side of the waveguide, six on the other side but tilted by approximately 90°. The rods are made of stainless steel with an optional galvanic deposit of iron, nickel or some other ferromagnetic material with a high curie point on the outside (the thickness if e.g. 30 μm). The roughness of the surface is increased to provide a higher surface resistivity. Moreover, the inside of each tube can be hollow and can be used for water cooling. The waveguide itself may also be made of metal or any other conductive material.

Figure 6:
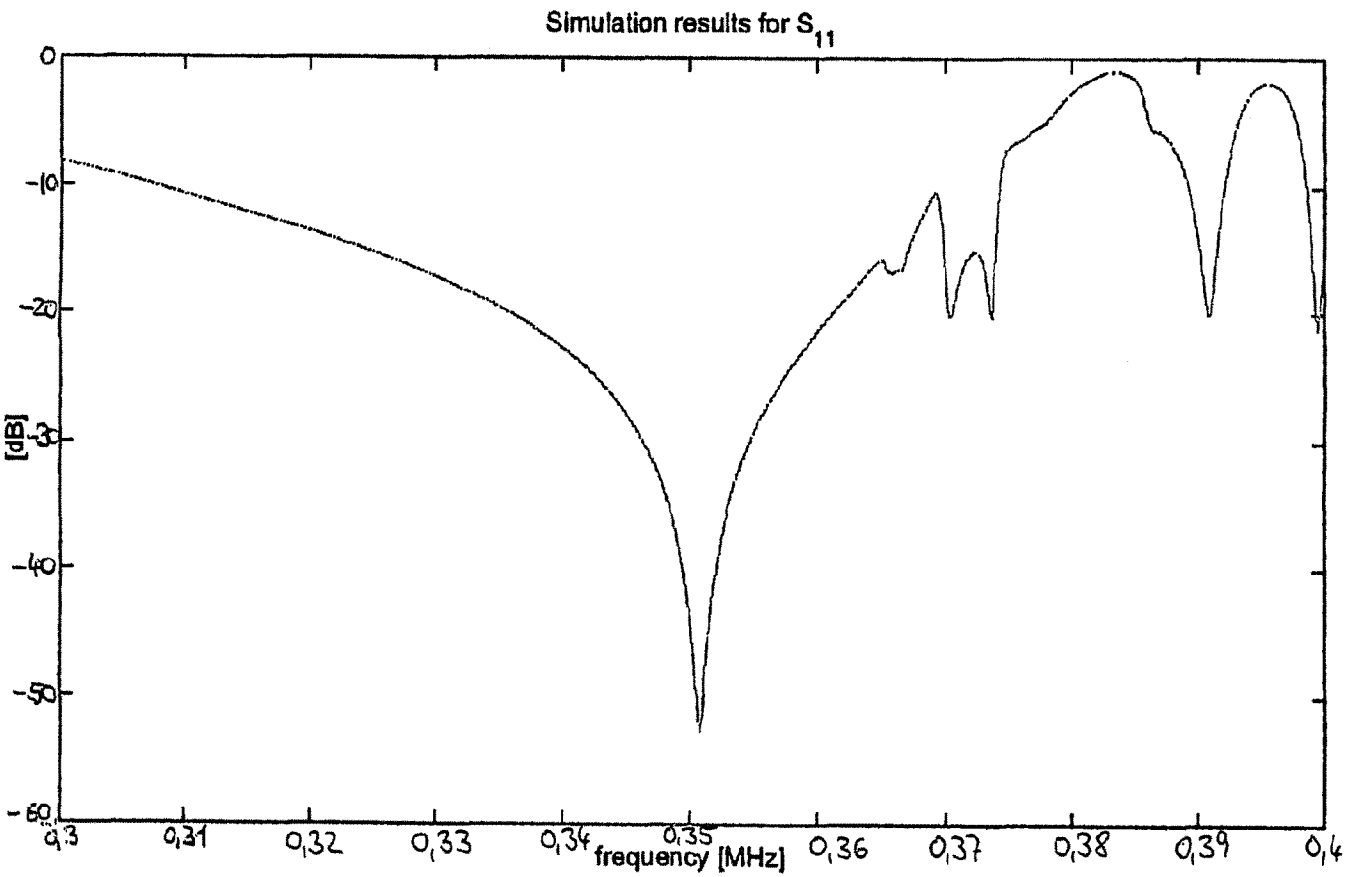
FIG. 6 is a diagram showing the absorption of the RF wave while using the load of FIG. 5.

FIG. 6 shows the S11 value (relates to the ratio of incoming to reflected radiation intensity) as measured in dB for the load as shown in FIG. 5 and with the particular dimensions as mentioned before. From this figure it is clear that the RF load provides a significant absorption for particular frequency of approximately 351 MHz.

Figure 8:
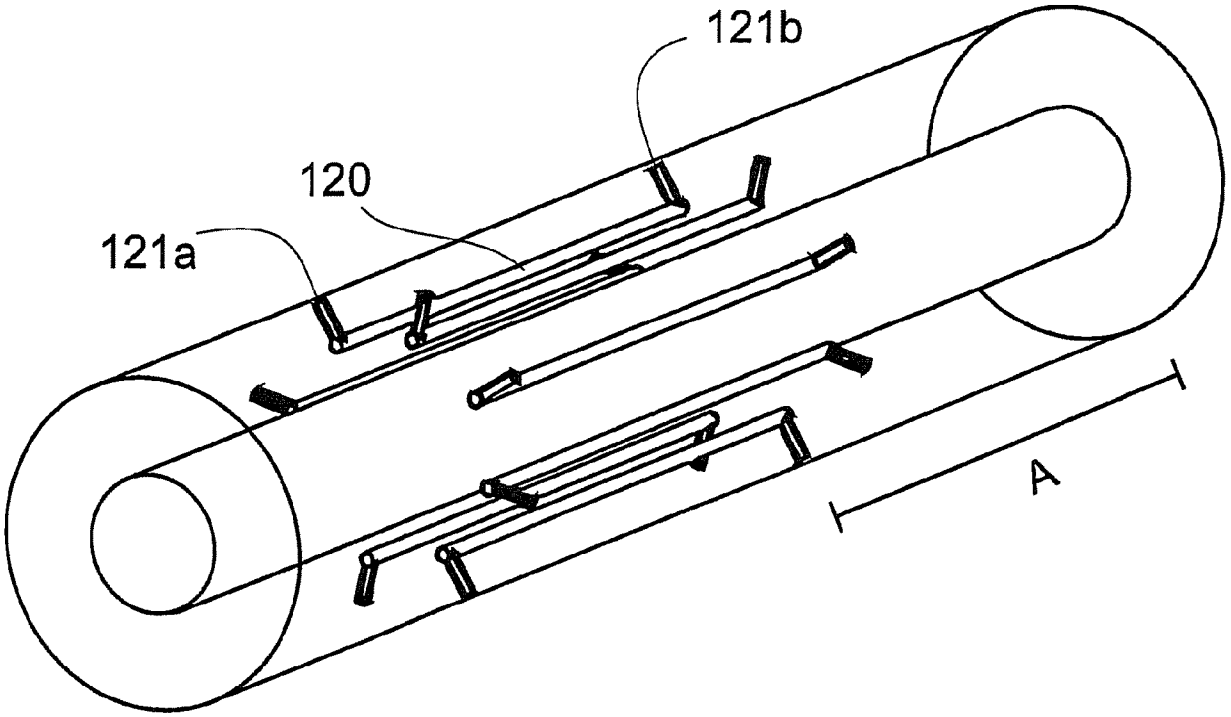
FIG. 8 depicts a distribution for the magnetic field for the RF load of FIG. 7.

FIG. 7 shows a perspective view of the load with a coaxial transmission line (see also FIG. 2*a*), wherein a plurality of metal rods 210 is provided in axial direction of the axial transmission line. A possible configuration has the following values: the length of the coaxial line is 2 m, an inner diameter Da is 150 mm and an outer diameter Db is 345 mm. Eight metal rods are symmetrically grouped around the inner conductor 210*b* and both the inner and outer conductor 210*a, b* are shortened at a distance of one half of the wavelength of the radio wave (measured from the end of the rod). Therefore, the length A as shown in FIG. 2*a* is equal one half of the wavelength. Because the length of the metal rods 120 is equal to one half of the wavelength, this has the effect that, when the radio wave has a maximum intensity at one end of the metal rod 120 it has also a maximum (but with opposite sign) at the other end of the metal rod 120, thereby amplifying the desired effect of absorbing the RF wave by the metal rods. This effect is also shown in FIG. 8 wherein a distribution for the magnetic field for this load is depicted (the coupling was done via electric field). In particular, FIG. 8 shows that a first maximum (black areas) for the H-field appears at a first end 121*a* of the metal rod 120 and, at the same time, a second maximum of the H-field appears at a second end 121*b* of the metal rod 120.

FIG. 9*a, b* show simulation results (again the S11 parameter measured in dB) for such a configuration, wherein the diameter of the rods were varied from 15 to 35 mm. The materials used for the rods were again stainless steel and iron with different magnetic permeability. Furthermore, the distance between the outer conductor and the rods were varied. The results are summarized in table 1 and table 2 as shown in FIG. 9*b*. The maximal absorption (S11 is maximal) is achieved, if A=50 mm, for a diameter of 15 mm and μ=5 (table 1) and, if A=60 mm, for a diameter of 15 mm and μ=10 (table 2).

In most cases the coupling was under critical. Only in the cases with very high losses, criticality was achieved. FIG. 10 shows the Smith chart displaying the resonance showing that a critical coupling can be achieved. The coupling can be improved, for example, by moving the position of the copper disk 214 (conductive plate at the terminating surface).

In general, a distance between the rods 120 and the outer conductor 210*b* should be between 5% to 25% of the radius of the outer conductor of the coaxial line in order to optimize the coupling to the electromagnetic field in that region. For reasons of mechanical simplicity the design was given by 30 mm rods made of stainless steel (μ=1). According to the simulations the bandwidth of the structure at −20 dB is approximately 40 KHz and the Q value is approximately 630. Moreover, the introduction of the metal rods 120 causes a detuning of the structure. The resonance is slightly shifted up to a frequency of 207 MHz.

For practical application, the metal rods 120 are made hollow and hence allow water cooling. Also the inner conductor will have to be cooled. In general, heating of the structure would cause an elongation of the rods 120 and hence a detuning of the load. The use of Invar instead of stainless steel can solve this issue since this material has a very low thermal expansion coefficient (any other material with a linear thermal expansion of the less $10^{-6}$ $K^{-1}$ can equally be used).

In summary, embodiments of the present invention provide RF loads such as high power dielectric free loads with resonant metal rods/tubes of half the wavelength of a desired operation frequency. These tubes can be used for water/liquid cooling of the structure, providing a cooling liquid at a temperature of more 150° C. with a pressure of more than 20 bars. Embodiments use, e.g., stainless steel or similar materials without any ceramics that are suitable for lower frequencies of few 10 MHz up to several GHz. Possible frequency ranges depend on the configuration. For example, for the coaxial configurations the RF wave may have a frequency between 10-3000 MHz, in particular between 100-500 MHz, or more particularly between 200-400 MHz. For waveguide configurations the RF wave may have a frequency between 300 MHz-3 GHz.

It is uncritical in handling and manufacturing and capable of providing cooling liquids with high temperature and high pressure, thereby allowing an efficient energy recovery process, for example, by optionally providing a cooling using a liquid with high pressure and temperature at the outlet. For example, water can be used so that energy recovery is possible (e.g. by using a sterling motor).

For the connection of the presented high temperature and high pressure load operating in dry air to parts at ambient temperature under vacuum a transition piece is needed. This piece could be a very thin metallic tube with a small copper layer and optionally with thin gold plating to avoid deterioration deposited on the inside. This will ensure low electromagnetic losses and at the same time provide a high thermal resistance.

Embodiments of the present invention provide two alternative solutions. One solution employs metal rods 120 of a particular length in order to absorb the electromagnetic waves by currents generated inside the metal rods 120 by the radio frequency wave. In an alternative solution, the electromagnetic wave is again absorbed by a metal structure, which is now however provided in a particular distance from the end surface in a coaxial transmission line. As result, reflecting RF waves from the end surface interfere with incoming RF waves so that these waves eliminate each other (by destructive interference) at the metal structure at the particular distance. Therefore, also for this solution the RF wave is absorbed. For example, the metal structure can be provided at a distance of one half of the wavelength of the RF wave (this can again relate to any wave of the frequency band; e.g. the middle frequency). The metal structure is moreover configured, such that a part of the incoming RF wave passed through the metal structure, whereas another part is reflected at the metal structure. This reflected part of the metal structure is, e.g., eliminated by a reflective part at the terminating surface of the incoming RF waves. Therefore, this is actually an anti-reflection arrangement for incoming RF wave.

In embodiments of the present invention the metal structure 220 is, e.g., provided by one or more disc(s) with holes 220*h*, arranged around a circumferential direction of the outer circumference of the disc or, alternatively, by a plurality of radial rods 221, 222, . . . extending radially outwardly, starting from an inner conductor 210*a* of the coaxial transmission line 210. The number of rods can be different, as e.g., only one, or two, or three, or four or eight. These examples are, however, not restrictive, any other metal structure can be used, which provides a certain reflectivity and transmissibility for the incoming RF wave (in the predetermined frequency band). Therefore, the metal structure 220 can also be a means for partial reflection of an incoming RF wave such that the non reflected part of the RF wave is transmitted by the metal structure 220 and is reflected at the conductive plate 214 terminating the waveguide 210.

In further embodiments the lengths of the metal rods 120 in each group (e.g. as shown in FIG. 5) or the metal rods 120 of FIG. 7 can be different so as to configure the RF load to damp a plurality of frequencies of the pre-determined frequency band (or to absorb all frequencies of the RF band). In addition, also the distances between the metal rods 120 within each group can vary and does not need to be equidistant as shown in FIG. 5. Furthermore, the metal rods 120 can optionally also be replaced by a metal structure, which is configured to absorb the RF wave in the wave guide or the coaxial cable and may, for example, be formed as a metal ring or some other curved or star-like configuration. Thus, the metal rods do not need to have a straight line shape, but comprise instead a shape configured to absorb the RF wave efficiently.

The metal rods may be formed as follows. The diameter of the rods may range from 10 mm (smaller values are possible, but for practical reasons not advisable) to 35/40 mm. The thickness of the disk may be from 3 to 50 mm and the number of holes may be from 3 to 10. The diameter of the radial rods may be from 5 to 50 mm and the number of radial rods may be from 2 to 20. Different materials are possible, which can be grouped in three classes: good conductors (such as cooper), poor non magnetic conductors (like certain types of stainless steel) and poor conductors with magnetic properties (like ordinary iron or steel).

In yet further embodiments the metal rods are not aligned in planes, but are arranged in different angles so as to provide an optimized absorption for RF wave with different polarizations.

FIGS. 12-14 depict further embodiments of RF loads.

The RF load 300 shown in FIG. 12 comprises an opening 312, a tapered portion 311 and an absorption portion 310 (as part of a wave guide) providing a cavity within which the RF wave can be absorbed by generating heat. The absorption portion 310 comprises a larger cross-sectional area than the opening part 312 and inside the absorption portion 310 a plurality of absorption elements 320 are provided. The absorption elements 320 comprise, e.g. metal with a thickness "b" (e.g. between 4-10 mm), wherein the elements 320 are, for example, formed as plates separated from each other by a further distance "a" (e.g. between 5 . . . 15 mm or about 10 mm).

The tapered portion 311 may, for example, be configured to increase the height L2 (e.g. should not exceed one half wavelength $\lambda_0$) of the opening 312 to the absorption portion 310 by 50 . . . 200% (or about 100%, but can be any value). The number n of absorption elements 320 may be such that the absorption portion 310 is filled with absorption elements 320 (dependent on the thickness "b" and the further distance "a") so that the electric field strength per cell (per absorption element) is n-times reduced, the area is increased so that the heat can easier transported and thus less thermal stress occurs. For example, 5 . . . 20 or about 10 absorption elements 320 are arranged in parallel.

The plurality of absorption elements 320 may comprise a plurality of tubes 322, which are configured to allow a liquid flow (for example of water with a temperature between 100 up to 250° C. through the plurality of elements 320, thereby cooling the absorption elements 320. In addition, the absorption portion 310 is terminated by a terminating surface 313 at the end in propagation direction of an incoming RF wave, wherein the RF wave enters the absorption portion 310 through an inlet structure 330. The inlet structure 330 may, e.g., be formed as a metal structure with one or more openings through which the RF wave can pass. The inlet structure 330 and the terminating surface 313 may both comprise metals (e.g. to reflect at least partially the RF wave) and may be configured to provide a $\lambda/4$-absorber (the distance B2 is about a quarter of the wavelength, i.e. B2=$\lambda/4$) or to support the formation of standing waves so that an incoming RF wave is trapped after passing the inlet structure 330 and can be efficiently be absorbed by the absorption elements 320.

The inlet structure 330 may, for example, comprise an opening whose size determines the input impedance of the RF load. Thus, the size (i.e. the area of the opening) may be adjusted such that a critical coupling is obtained and the power of a reflected RF wave vanishes and the incoming RF wave is completely absorbed.

FIG. 13 shows a cross-sectional view of the RF load 300 through the absorption portion 310 along the cross-sectional line CC' (see FIG. 12). The absorption portion 310 comprises in these embodiments a rectangular cross-section (which may be different in other embodiments) and the absorption elements 320 are arranged as plates extending along one of the two main directions of the cross-sectional areas of the absorption portion 310 as a stacked configuration (only the first two plates are shown). In addition, tubes 322 (e.g. liquid tubes) are formed along the absorption elements 320 for allowing a fluid flow 340 (e.g. water) with a pressure of, e.g., up to 100 bars to cool the absorption elements 320 such that the fluid flow 340 flows perpendicular to the incoming RF waves. The tubes 322 are only schematically depicted inside the absorption elements 320, but they are also provided on the outer surface of the absorption portion 310 to cool the wave guide also from the outside. The fluid flow 340 may comprise a cooling liquid as, for example, water so that the water flow 340 enters the tubes 320, for example, on the right hand side (after splitting it) and after passing the absorption elements 320 the heated water flow exits the absorption portion 310, for example, on the left hand side.

In a further embodiment for the RF load 300 the absorption elements 320 as shown in FIG. 12 are coated with a thin (e.g. below 1 mm) ferrite layer 374 (ferrite coating) to enhance the absorption of the RF wave. Optionally, the stacked structure of absorption elements 320 can be formed by forming ferrite layers 370 on a cell made of, for example, iron (or copper or aluminium) so that the iron (or copper or aluminium) is coated with the ferrite layer 374. By using the ferrite coating also materials as aluminium or copper (e.g. to provide a good heat transfer) may be used for the absorption elements 320 and/or the inlet structure 330. All other components of the embodiment depicted in FIG. 13 are the same as in the embodiment as depicted in FIG. 12 so that a repeated description is omitted here. In addition, only two elements 320 are shown in FIG. 13 and the remaining elements are also omitted. Again, the distance between adjacent absorption elements 320 may, for example, be selected by the further distance "a" being e.g. between 5 . . . 15 mm or about 10 mm and the thickness "b" of the absorption elements 320 being e.g. between 4-15 mm or between 6-10 mm.

The ferrite layer 374 may be formed as thin layer having a thickness, e.g., between 50-500 μm or 100-300 μm and may be applied by using plasma spraying techniques. For example, a thin ferrite layer can be sprayed on metal (for example, iron) to form a microwave absorbing layer. The particular ferrite material used for the ferrite layer 374 is selected based on the particular frequency of the RF wave which shall be absorbed. For example, a list can be provided wherein for the predetermined frequency band one or more suitable ferrite materials are listed. These ferrite layers are advantageous in that they can withstand high temperatures and are robust due to their small thickness and thus minimize the mechanical and thermal stress. Optionally, also the inlet structure 330 can be coated in the same way by a thin ferrite layer.

The plurality of absorber elements 320 may also extend from the terminating surface 313 to the inlet structure 330 and each of the plurality of absorber elements 320 may comprise a cavity. In this arrangement the inlet structure 330 can be formed as a plurality of openings for providing a propagation path of an incoming RF wave into the cavity of each the plurality of absorber elements 320.

Figure 14A:
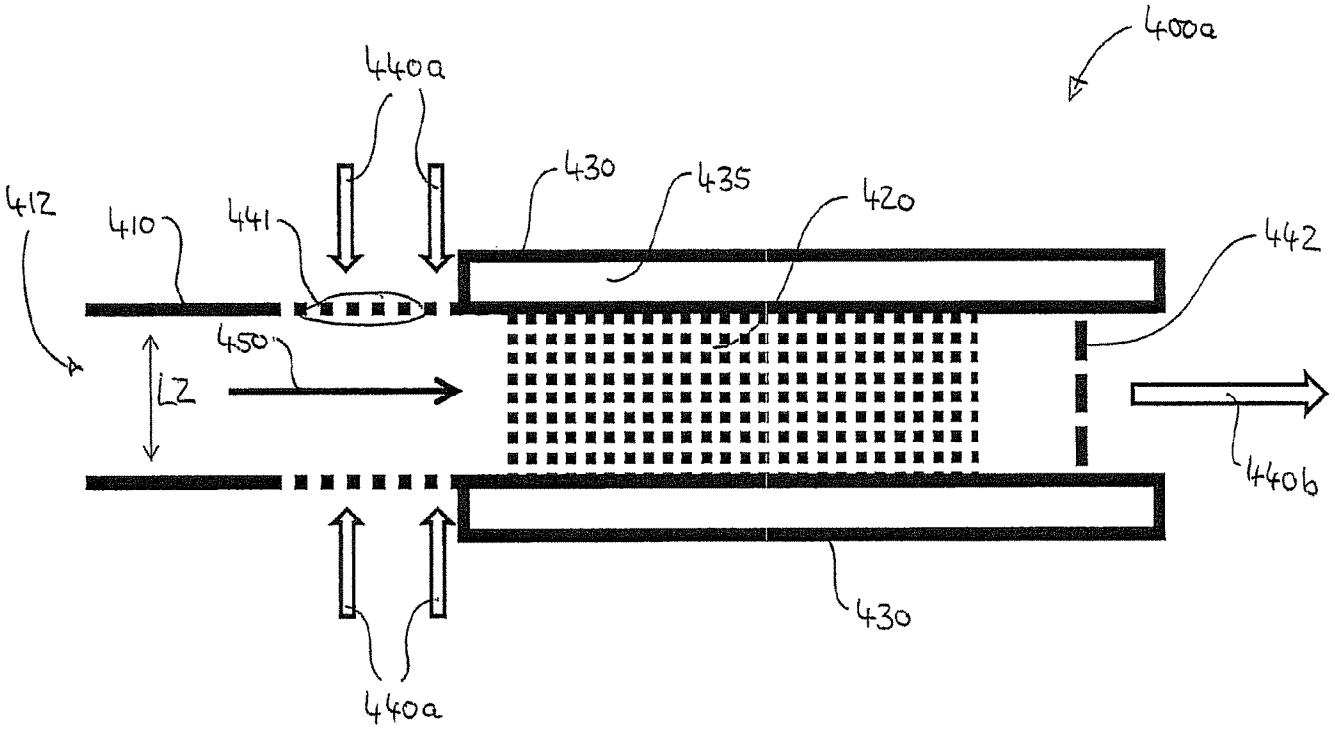

FIG. 14A depicts an RF load 400*a* according to a further embodiment with a waveguide 410 comprising an opening 412 for allowing an RF wave 450 to enter the RF load 400*a*. The waveguide 410 comprises a cooling gas (air or inert gas) inlet 441 (e.g. a perforated waveguide portion) which is configured to provide an air inlet, but is RF leak tight implying that the incoming RF wave 450 cannot leave the RF wave guide 410 through the perforated wave guide portion 441. Downstream (in the propagation direction of the incoming RF wave 450) after the perforated waveguide portion 441 the RF load 400*a* comprises an enclosure 430 (e.g. made of metal) comprising an optional thermal insulation 435. For cooling air at ambient temperature, but also any other cooling gas can be used.

The metal enclosure 430 is configured to withstand high temperature and extends between the perforated wave guide portion 441 and an air outlet for the hot air 440*b*. The metal enclosure 430 provides a housing for ceramic foam 420 arranged over a length B. A perforated shield 442 (which comprises, e.g., metal) is arranged along the propagation path of the RF wave 350. The ceramic foam 420 is configured to absorb the incoming RF wave 440 and, at the same time, to provide a passage way for incoming airflow 440*a* through the perforated waveguide portion 441 and exits the RF load 400*a* through the perforated shield 442 defining the outlet of the hot air. The perforated metal shield 442 defines an RF enclosure in that the incoming RF wave 450 cannot pass the perforated metal shield 442 at the outlet for the airflow 440*b* and will, for example, be reflected back to the absorbing section.

The wave guide 410 may again comprise a rectangular cross-section with a height L2 (see FIG. 1*b*) with a value of, for example, one half of the wavelength (λ/2) of the RF wave in the waveguide (which in general will differ from the corresponding vacuum wavelength $\lambda_0$). The length B of the ceramic foam 420 as arranged in the metal enclosure 430 may comprise any value, which is sufficiently large to absorb the RF wave.

Therefore, the RF load as depicted in FIG. 14A absorbs an incoming RF wave 450 in the ceramic foam 420 which is provided within a metal enclosure 430, thereby heating up the ceramic foam 420, which in turn is cooled by an airflow 440*a*, entering through the perforated wave guide portion 441 with an ambient temperature and leaves as very hot air 440*b* the perforated metal shield 442 after having cooled the ceramic foam 420. The thermal insulation 435 provided inside or with the metal enclosure 430 is configured to provide a temperature inside the metal enclosure so that, for example, the hot air 440*b* leaving the RF load 400*a* may comprise a temperature of up to 800° C. Optionally, the thermal insulation 435 can be water cooled so that the outside of the enclosure 430 (outer surface) is at ambient or moderate temperature (below 60° C.). For the water cooling further water tubes can be arranged in the thermal insulation 435.

Optionally, the ceramic foam 420 comprises impurities to ensure that the incoming RF wave 450 is efficiently absorbed by the ceramic foam 420. In addition, the ceramic foam 420 is adapted to be permeable for the airflow such that an efficient cooling can be provided.

In this embodiment the incoming radio wave 450 is absorbed along the way through the ceramic foam.

Figure 14B:
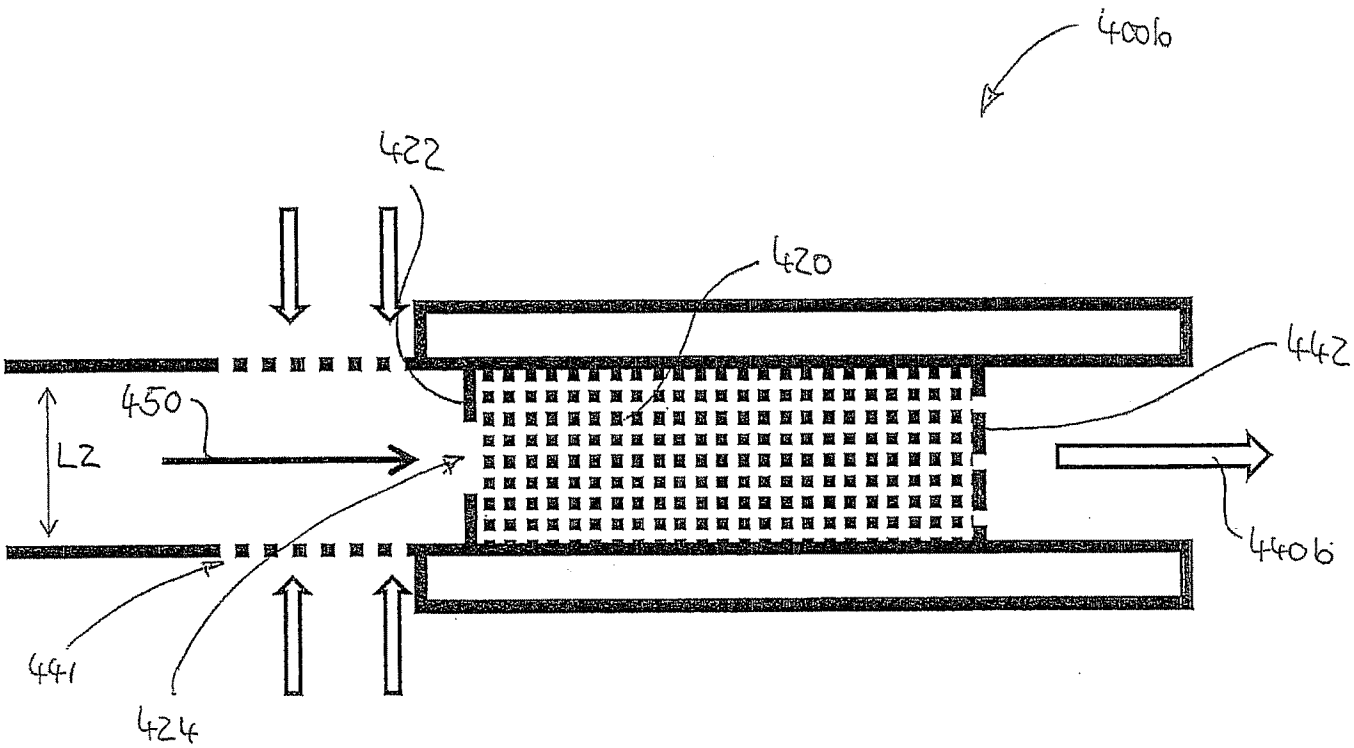

FIG. 14B depicts a further embodiment of an RF load 400*b* based on ceramic foam 420, which differs by the embodiment as shown in FIG. 14A in that it defines a standing wave structure, wherein the RF wave 450 is trapped and can be absorbed by the ceramic foam. This effect is achieved in that, on the one hand, at the inlet for the incoming wave 450 an inlet structure 422 (comprising e.g. metal) is arranged, which comprises, e.g., an opening 424 for the incoming RF wave 450. This inlet structure 422 is similar to the metal structure as defined in the embodiments of FIG. 2B to 2I. In addition, the standing wave structure RF load 400*b* of FIG. 14B comprises a terminating structure 442 (comprising e.g. metal) at the end of the RF load 400*b* and the ceramic foam 420 is arranged between the inlet structure 422 and the terminating structure 442 which are spaced from each other such that an incoming RF wave 450 is trapped in the region between both structures 422 and 442 by forming a standing wave. For this standing wave the ceramic foam 420 arranged in the space of the standing wave absorbs the wave energy, thereby heating an airflow coming from the air inlet 441 (the perforated wave guide portion), entering the opening 424 and passing through the ceramic foam 420, thereby cooling the ceramic foam and leaving the RF load 400*b* via the terminating (metal) structure 442 as a hot airflow 440*b*.

The height L2 may again have a value of, for example, one half of the wavelength (λ/2) of the RF wave in the waveguide in the resonant mode (e.g. to form a standing wave). If the RF load does not operate in the resonant mode (e.g. in the travelling wave mode), L2 may have also different values.

In order to form a standing wave between the inlet structure 422 and terminating (metal) structures 442, the length B between both structures is arranged accordingly (for example a multiple of one half of the wavelength of the incoming RF wave 450) so that B may again comprise a value between 0.5 and 2 wavelengths. Alternatively, a λ/4-Absorber is formed in that B is approximately one quarter of the wavelength of the RF wave.

Figure 14C:
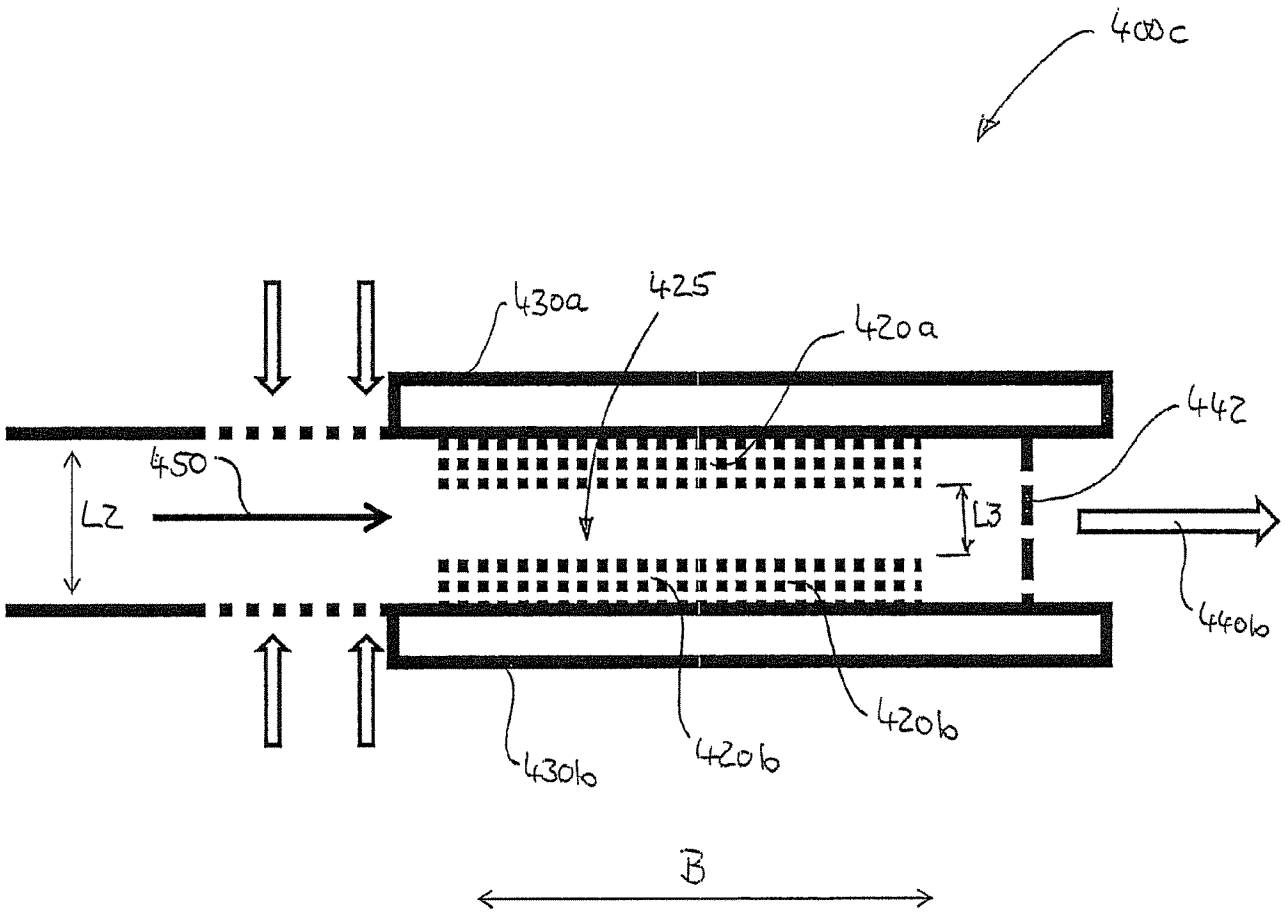

FIG. 14C depicts a further embodiment, which is similar to the embodiment as shown in FIG. 14A and differs from the embodiment of FIG. 14A in that the ceramic foam 420 is not arranged continuously between the metal enclosure 430, but that the ceramic foam 420 is, for example, arranged as a first part 420*a* at a top portion of the metal enclosure 430 and as a second part 420*b* arranged at a bottom part of the metal enclosure 430*b*. The first part 420*a* and the second part 420*b* may, for example, be spaced from each other by a length L3 which is arranged such that the incoming RF wave 450 is absorbed over the whole length B of the ceramic foam 420. Therefore, the embodiment of FIG. 14C shows a travelling wave structure with hot air not going through the ceramic foam.

An advantage of the embodiment as shown in FIG. 14C is that the air 440 can pass the region of the ceramic foam 420 with low or no resistance so that the applied pressure is lower than in the embodiment as shown in FIGS. 14A and 14B. In addition, the distance L3 can be arranged such that the incoming RF wave is absorbed continuously over the whole length of the ceramic foam, which may, e.g., be achieved in that the distance L3 may vary along the propagating wave direction (for example from a larger value towards a smaller value).

Figure 14D:
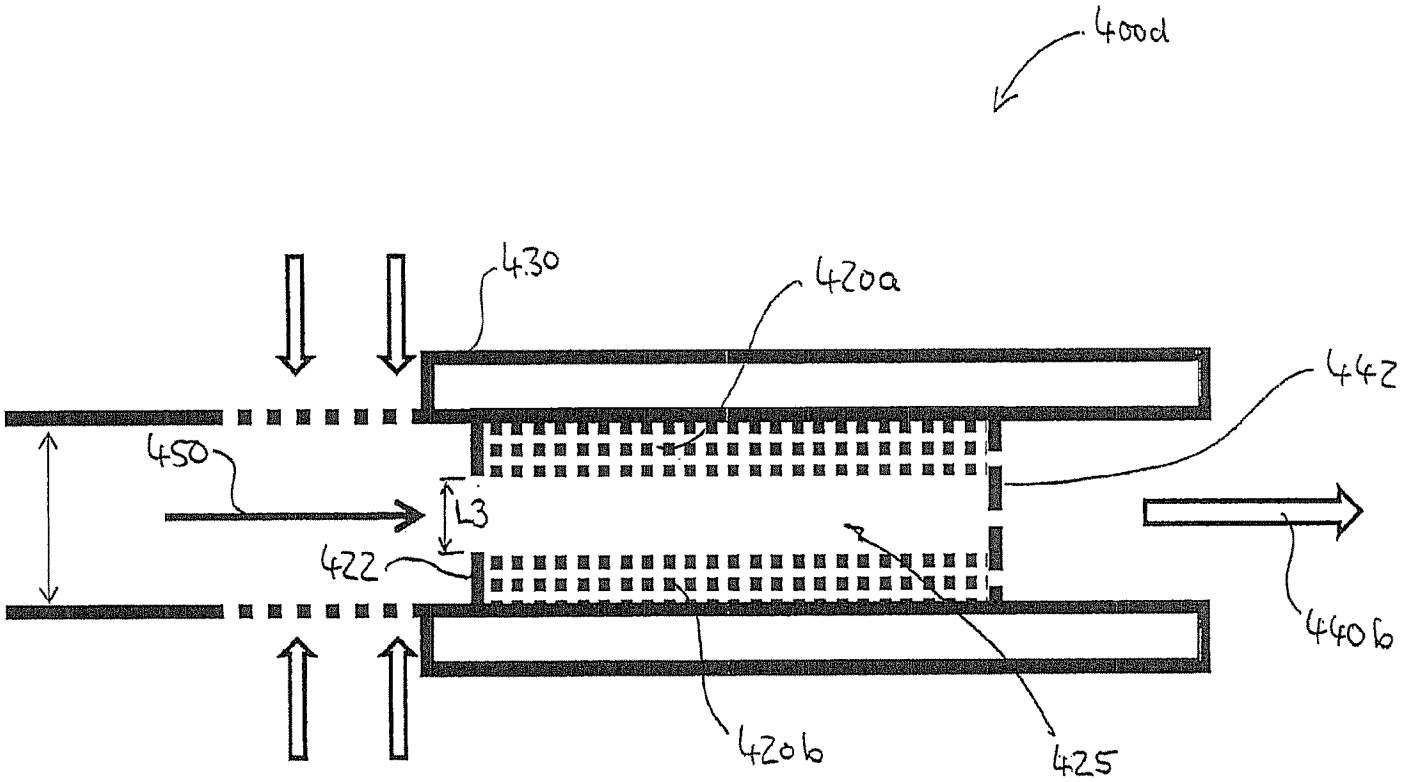

FIG. 14D depicts a further embodiment of a standing wave structure with air not going through the ceramic foam, which combines the features as shown in FIGS. 14B and 14C. Again, the ceramic foam 420 is formed, for example, in two parts 420*a*, 420*b* along the propagation direction of the incoming RF wave 450 between a inlet metal structure 422 and a terminating structure 442 which are adapted such that the incoming RF wave 450 is trapped between both (metals) structures 422, 442 by forming a standing wave between the inlet metal structure 422 and the terminating metal structure 442. Optionally, the ceramic foam may also be arranged along a circumferential direction of the metal enclosure 430, which may, for example, have a rectangular shape.

As in the embodiment of FIG. 14C, the air does not have to go through the ceramic foam, thereby decreasing the applied pressure on the air to cool the ceramic foam. The length B between the inlet metal structure 422 and the terminating structure 442 is arranged such that a standing wave is formed so that the standing wave can be absorbed by the ceramic foam arranged between both metal structures.

The cross-sectional area of the RF wave guide 410 as shown in FIG. 14A-14D may comprise a rectangular shape as it is shown in FIG. 1B with an aspect ratio of 1:c, wherein c is between 1.5 and 3 or about 2). The distance L3 may, for example, comprise a value of 0.5, 0.6 or 0.7 of the wave guide wavelength $\lambda_0$.

The embodiments of an RF load 400 as shown in FIG. 14A-14D define a ceramic foam 420 either be arranged continuously between the metal enclosure 430 (i.e. the foam covers the whole rectangular area in a cross-sectional view perpendicular to the propagation direction) or, as shown in FIGS. 14C and 14D that openings are arranged along the propagation direction of the RF wave (when viewed in a cross-sectional view perpendicular to the propagation direction). As result, air coming through an air inlet 441 with ambient temperature can simply flow through the openings of the ceramic foam 420 thus providing an efficient cooling mechanism.

Although FIGS. 14C and 14D show only a single opening more openings can be provided in further embodiments. In addition, more complex air passage ways where no ceramic foam is formed through the ceramic foam may be provided. In this case, the air or gas does not need to pass the ceramic foam, but can flow along the air passage ways. The air passage ways can be formed so that they provide a path sufficiently wide so that air can pass through without applying additional pressure, but at the same time are sufficiently small so that the RF wave cannot pass through without interfering strongly with the ceramic foam. The result can be optimized by forming accordingly the one or more air passage ways to compromise between both effects.

Therefore, instead of cooling tubes this RF load 400 uses ceramic foam as absorber in the microwave range (starting from 300 MHz) making it applicable for cooling with air. The ceramic foam acts like fireclay stones in a steel/iron enclosure (oven) which can withstand very high temperatures—it can get red or even white hot glowing without being damaged.

Therefore, these waveguide structures contain a block of air cooled porous dielectric foam 420 (e.g. a block of creaming foam) and act as an actual RF/microwave absorber. The porous ceramic block 420 acts as a microwave absorber and is not brazed to the metallic enclosure 430. However, this ceramic foam 420 is adapted for good microwave absorption by using a suitable material such as silicon carbide with open porous to ensure a good air flow.

In the embodiments as depicted with FIGS. 1 to 14 a RF window (air or gas tightened) may be added at the far left of the structure (not shown in the figures), i.e. an incoming RF wave passes first the RF window before entering the various RF loads 100, 200, 300, 400. In addition, the systems including the RF loads have a temperature gradient in that ambient temperature is on the left (before the oven) and high temperature (up to 600 C) inside the RF load (or microwave oven).

The inlet (metal) structure 330, 422 may, for example, comprise an opening to provide a propagation path for the incoming RF wave whose size determines the input impedance of the RF load. Thus, the size (i.e. the area of the opening) may be adjusted such that a critical coupling is obtained and the power of a reflected RF wave vanishes and the incoming RF wave is completely absorbed. The smaller the opening the weaker the coupling and for a critical coupling the Q value becomes: $Q_{loaded}=Q_0/2$. Using the ferrite coating for the RF load 300 it is possible to achieve $Q_0$ values below 20 or below 2.

The operating frequency bandwidth may be defined by the frequency range with a 20 dB attenuation, i.e. $S_{11}=-20$ dB, around the resonant frequency $f_{res}$ or about the value given by: $f_{res}/(Q_{loaded}\cdot 10)$. The resonant condition is, however, temperature dependent and depends on the concrete materials and their thermal expansion coefficients. Therefore, there might be some fine tuning needed to find a lowest possible Q value.

The hot air or the hot liquid as generated in the RF load 400 of FIG. 14 can again be used, for example, in a Stirling engine to generate electricity from the heat. Alternatively, the hot air can be used in a gas turbine to generate electricity from the heat. Here it is of advantage that the air is heated up sufficiently (i.e. up to 800° C.) so that these machines can operate efficiently.

The embodiments described above and the accompanying figures merely serve to illustrate the RF load according to the present invention and the beneficial effects associated therewith, and should not be understood to imply any limitation. In addition, features described with a particular figure or embodiment may also be combined with features as described with other figures or other embodiments. The scope of the patent is solely determined by the following claims.

CERN—European Organization for Nuclear Research

REFERENCE SIGNS

100; 200; 300; 400 RF loads
110; 210; 310; 410 wave guides
112; 312; 412 opening
114 conductive plate
120, 120*a*, 120*b* metal rods
121 ends of the metal rods
122 surface of a metal rod
124 tube inside a metal rod
126 induced current in the metal rods
130 means for cooling
210*a, b* inner and outer conductor of coaxial transmission line
211 tube inside the inner conductor
220 metal structure
220*h* holes in metal structure
221, 222, 223 radial metal rods
311 tapered portion
313 terminating surface
320 absorber elements
322 tubes
330 inlet structure
374 ferrite coating
420 ceramic foam
425 air passage way
430 metal enclosure
435 thermal insulation
440 cooling gas
441 cooling gas inlet
442 perforated shield
450 incoming radio frequency wave

The invention claimed is:

1. A radio frequency load for absorbing a radio frequency wave having a frequency in a predetermined frequency band and a wavelength $\lambda$, said radio frequency load comprising:

a waveguide with a portion having an opening for said radio frequency wave; and at least one metal rod provided in said waveguide, said at least one metal rod having a length (L) of one-half of said wavelength λ to damp said radio frequency wave, wherein said waveguide comprises a coaxial shape with an inner conductor and an outer conductor, and wherein said at least one metal rod being arranged along an axial direction of said coaxial transmission line.

2. The radio frequency load according to claim 1, wherein said at least one metal rod is hollow such as to define at least one tube for carrying a cooling medium allowing a temperature of more than 100° C. and a pressure of more than 20 bar.

3. The radio frequency load according to claim 1, wherein said at least one metal rod are ceramic-free.

4. The radio frequency load according to claim 1, wherein a terminating surface opposite to said opening is provided with an electric conductive plate.

5. The radio frequency load according to claim 1, wherein said frequency is between 10-3000 MHz, in particular between 100-500 MHz, more particular between 200-400 MHz, or said frequency is between 300 and 3000 MHz.

6. The radio frequency load according to claim 1, wherein said at least one metal rod comprise a diameter within a range of 10-50 mm.

7. The radio frequency load according to claim 1, wherein said at least one metal rod comprises a material selected from the group consisting of: good conductors, poor non magnetic conductors, and poor conductors with magnetic properties.

8. The radio frequency load according to claim 1, wherein said at least one metal rod comprise a material with a coefficient of thermal expansion of less than 10−5 K−1, and in particular Invar.

9. The radio frequency load according to claim 1, said at least one metal rod comprising:

a first group of metal rods arranged in parallel within a first common plane, and a second group of metal rods arranged in parallel within a second common plane.

10. The radio frequency load of claim 9, wherein said waveguide comprises a rectangular cross section perpendicular to a propagation direction of said radio frequency wave such that said rectangular cross section comprise a long side and a short side, and wherein said first common plane and said second common plane are inclined with respect to said long side and with respect to said short side.

11. The radio frequency load according to claim 9, wherein each metal rod in said first group and in said second group being arranged closer to said conductive plate than to the opening of said waveguide.

12. The radio frequency load according to claim 1, said at least one metal rod being arranged in parallel to said outer conductor.

13. The radio frequency load according to claim 1, said at least one metal rod comprising a plurality of metal rods being mounted equidistantly in angular direction on said outer conductor.

14. The radio frequency load according to claim 1, wherein said electrical conductive plate connects said outer conductor with said inner conductor such as to provide a short between said outer and inner conductor.

15. The radio frequency load according to claim 1, wherein said at least one metal rod are separated from said conductive plate by one-half of said wavelength λ.

16. The radio frequency load according to claim 1, wherein said at least one metal rod is hollow such as to define at least one tube for carrying a cooling medium allowing a temperature of more than 100° C. and a pressure of more than 20 bar, and wherein each of said at least one tube provides a passage for said cooling medium from said outer conductor to said inner conductor to cool said at least one metal rod together with said inner conductor with said cooling medium.

17. The radio frequency load according to claim 1, further comprising a radio frequency wave window provided at said opening, wherein said radiofrequency wave window is configured to be permeable for said radio frequency wave and is configured to block gas.

18. The radio frequency load according to claim 2, further comprising an electricity generator using a conversion process by providing said cooling medium to said tubes or said cooling gas inlet and converting energy of absorbed RF waves into electricity.

19. The radio frequency load according to claim 18, wherein said electricity generator comprises a Stirling engine.

20. The radio frequency load according to claim 7, wherein said good conductors comprises copper.

21. The radio frequency load according to claim 7, wherein said poor non magnetic conductors comprises stainless steel.

22. The radio frequency load according to claim 7, wherein said poor conductors with magnetic properties comprises iron.

23. A radio frequency load for absorbing a radio frequency wave having a frequency in a predetermined frequency band and a wavelength λ, said radio frequency load comprising:

a coaxial transmission line with a portion having an opening for said radio frequency wave, said coaxial transmission line comprising an inner conductor, an outer conductor, and a conductive plate arranged on an opposite side to the opening to short said inner and outer conductor; and one or more metal structures being arranged between said inner conductor and said outer conductor, said one or more metal structures are arranged in a predetermined distance from the metal plate to damp said radio frequency wave, wherein said coaxial transmission line comprises a coaxial shape, and wherein said one or more metal structures are arranged along an axial direction of said coaxial transmission line.

24. The radio frequency load of claim 23, wherein said one or more metal structures are configured to be transmissive for a part of said radio frequency wave and reflective for a remaining part of said radio frequency wave.

25. The radio frequency load of claim 23, wherein said one or more metal structures comprise a metal disc with holes arranged along a circumferential direction of said metal disc.

26. The radio frequency load of claim 23, wherein said one or more metal structures comprise one or more of radial metal rods extending along a radial direction of said coaxial transmission line to connect said inner conductor with said out conductor.

27. The radio frequency load according to claim 26, said at least one radial metal rod being hollow such as to define tubes for carrying a cooling medium allowing a temperature of more than 100° C. and a pressure of more than 20 bar such that said cooling medium is carried from said outer conductor to said inner conductor to cool said one or more radial metal rods together with said inner conductor.

28. The radio frequency load according to claim 23, wherein said metal structure comprises an opening with a size, wherein said size is configured to prevent reflection for an incoming radio frequency wave.

29. A radio frequency load for absorbing a radio frequency wave having a frequency in a predetermined frequency band and a wavelength λ, said radio frequency load comprising:

an absorption portion having an opening for said radio frequency wave;

an inlet structure and a terminating surface to provide a resonator for said radio frequency wave; and a plurality of absorber elements arranged between said inlet structure and said terminating surface and which are configured to damp said radio frequency wave, wherein the absorption portion, the inlet structure, and the terminating surface form a waveguide that has a coaxial shape, and wherein said plurality of absorber elements are arranged along an axial direction of said waveguide.

30. The radio frequency load of claim 29, wherein said inlet structure and said terminating surface are spaced from each other by one quarter of said wavelength λ or such that a standing wave is formed from an incoming radio frequency wave.

31. The radio frequency load of claim 29, wherein said absorption portion comprises a larger extension than said opening measured perpendicular to a propagating radio wave, the radio frequency load further comprising a tapered portion connecting said opening with said absorption portion, and wherein said plurality of absorber elements are formed as a stack of metal plates comprising tubes providing a flow path for a cooling liquid.

32. The radio frequency load according to claim 29, wherein at least one of said plurality of absorber elements and said inlet structure comprises a ferrite coating.

33. The radio frequency load of claim 32, wherein said ferrite coating comprises a thickness between 50 μm and 500 μm formed by plasma spraying.

34. The radio frequency load according to claim 29, wherein said plurality of absorber elements comprise copper and/or iron and/or nickel.

35. A radio frequency load for absorbing a radio frequency wave having a frequency in a predetermined frequency band and a wavelength λ, said radio frequency load comprising:

an enclosure with an opening for said radio frequency wave;

ceramic foam arranged inside said enclosure such that said radio frequency wave along its propagation passes at least partly said ceramic foam; and a cooling gas inlet configured to provide said cooling gas as cooling medium to said ceramic foam, wherein said ceramic foam is configured to absorb said radio frequency wave and is configured to be permeable for said cooling gas to cool said ceramic foam, wherein said enclosure comprises a waveguide having a coaxial shape, and wherein the ceramic foam is arranged along an axial direction of said waveguide.

36. The radio frequency load of claim 35, wherein said cooling gas inlet structure is formed as a perforated waveguide portion and/or said enclosure comprises metal and a thermal insulation comprising an additional cooling.

37. The radio frequency load according to claim 35, further comprising an inlet structure and a perforated shield providing a terminating surface for preventing said radio frequency wave from leaving said enclosure, wherein said inlet structure and said perforated shield are configured to provide a resonator for said radio frequency wave by forming a standing wave from an incoming radio frequency wave, wherein said perforated shield is further configured to provide an outlet for said cooling gas after said cooling gas has passed at least part of said ceramic foam.

38. The radio frequency load according to claim 35, wherein said ceramic foam comprises one or more air passage ways providing a flow path for said cooling gas, wherein said air passage ways are free of ceramic foam to alleviate a flow of said cooling gas through said ceramic foam.

* * * * *